US012624600B2

(12) United States Patent
Pleysier et al.

(10) Patent No.: US 12,624,600 B2
(45) **Date of Patent: *May 12, 2026**

(54) MOVABLE DRILL ROD SPACER ASSEMBLY

(71) Applicant: Wallis Engineers Pty Ltd, Midvale WA (AU)

(72) Inventors: Jesse David Pleysier, Beckenham WA (AU); Paul Kalisch, Darch WA (AU)

(73) Assignee: Wallis Engineers Pty Ltd, Midvale WA (AU)

( * ) Notice: Subject to any disclaimer, the term of this patent is extended or adjusted under 35 U.S.C. 154(b) by 0 days.

This patent is subject to a terminal disclaimer.

(21) Appl. No.: 19/037,390

(22) Filed: Jan. 27, 2025

(65) Prior Publication Data

US 2025/0250869 A1 Aug. 7, 2025

Related U.S. Application Data

(63) Continuation of application No. 18/031,635, filed as application No. PCT/AU2021/051205 on Oct. 14, 2021, now Pat. No. 12,234,693.

(30) Foreign Application Priority Data

Oct. 14, 2020 (AU) ..... 2020903735

(51) Int. Cl.
*E21B 19/15* (2006.01)

(52) U.S. Cl.
CPC ..... *E21B 19/15* (2013.01)

(58) Field of Classification Search
CPC ..... E21B 19/15; E21B 19/155; E21B 19/14
USPC ..... 414/22.51–22.71; 211/60.1, 70.4; 175/85
See application file for complete search history.

(56) References Cited

U.S. PATENT DOCUMENTS 12,234,693 B2 * 2/2025 Pleysier ..... E21B 19/15

* cited by examiner

*Primary Examiner* — Lynn E Schwenning
(74) *Attorney, Agent, or Firm* — Collard & Roe, P.C.

(57) ABSTRACT

A drill rod spacer assembly is formed of a plurality of spacer members each movable to a first position, and a drive transfer arrangement configured operable for receiving a drive for moving a body. The body is configured for interacting with a spacer member while moving so as to move same to its first position. The drill rod spacer mover has a detent member configured operable for supporting a respective spacer member in its first position when the body moves to interact with another spacer member. More than one drill rod spacer mover can be arranged to form a drill rod spacer mover arrangement for operable use with a drill rod storage assembly.

23 Claims, 20 Drawing Sheets

MOVABLE DRILL ROD SPACER ASSEMBLY

CROSS REFERENCE TO RELATED APPLICATIONS

This application is a continuation of and Applicant claims priority under 35 U.S.C. § 120 of U.S. patent application Ser. No. 18/031,635 filed on Apr. 13, 2023, which application is a national stage application under 35 U.S.C. § 371 of PCT Application No. PCT/AU2021/051205 filed on Oct. 14, 2021, which claims priority under 35 U.S.C. § 119 of Australian Application No. 2020903735 filed on Oct. 14, 2020, the disclosures of each of which are hereby incorporated by reference. A certified copy of priority Australian Patent Application No. 2020903735 is contained in parent U.S. patent application Ser. No. 18/031,635. The International Application under PCT article 21(2) was published in English.

BACKGROUND OF THE INVENTION

1. Field of the Invention

In one aspect, a movable drill rod spacer member assembly is disclosed and a mover therefor.

2. Description of the Related Art

Drill rigs are used for exploratory drilling in the field of mineral, and oil and gas exploration, along with other applications, such as drilling for water. The drill rig comprises a mast that handles a string of drill rods that is progressively built as the drill string drills its way into the earth. As the current drill rod is lowered into the ground by the drilling operation, it will be necessary to add another rod to the drill string. A rod handler is used to take the next drill rod from a storage bin and place it in an operational position for attachment to the end of current drill string so as to extend the length of the drill string once the new rod is attached. The rod handler also returns the rod to the rod storage bin as the string is disassembled.

When stored in a storage bin, it is usual to provide a spacer between layers of drill rods to assist in the removal/placement process. In view of the nature of the equipment, risk exists (which can be significant) to human operators when involved in the manual removal/replacement of drill rods and/or respective spacers. Therefore, there exists a need/market for a solution that seeks to provide a way of reducing such risk in the course of transfer of drill rods from/to storage bins during drilling operations.

Accordingly, it is against this general background that the embodiments described herein have been developed.

SUMMARY OF THE INVENTION

According to a first principal aspect, there is provided a drill rod spacer assembly comprising:

- a plurality of spacer members each movable to a first position,
- a drive arrangement for moving a body,
- the body configured for interacting with one or more spacer members while moving so as to move same to its first position,
- a detent member configured operable for supporting a respective one of the spacer members in its first position when the body moves to interact with another one of the spacer members.

Embodiments of the above-described principal aspect, and those described below, may comprise or incorporate, either individually or in combination, any of the following described features.

In one embodiment, one or more spacer members are arranged in operable association with a respective detent member.

In one embodiment, the or each spacer member is moveable between its first position and a respective second position, said second position being one in which the spacer member provides support to one or more drill rods.

In one embodiment, interaction between the body and the or each spacer member serves to move same to or toward its first position when the body is moving in a first direction of movement, and permit movement of the or each spacer member away from its first position when the body is moving in a second direction of movement. Preferably the second direction of movement is opposite to the first direction of movement.

In one embodiment, each spacer member is of elongate form, of finite length and thickness.

In one embodiment, a portion of the elongate form of each spacer member is configured so as to provide a support surface for supporting one or more drills rods when the spacer member is in the second position.

In one embodiment, a portion of each spacer member is configured so as to interact with the body in the movement of the spacer member to or toward its first position.

In one embodiment, the or each spacer member is arranged so as to rotate or pivot about a respective axis of rotation in moving toward or away from its respective first position.

In one embodiment, the axis of rotation of a respective spacer member is near a respective end thereof.

In one embodiment, the axis of rotation of a respective spacer member is intermediate the portion for supporting one or more drill rods when the spacer member is in the second position, and the portion of the spacer member that interacts with the body for moving the spacer member to or toward its first position.

In one embodiment, the scope of freedom of rotation of the spacer member about its axis of rotation is finite.

In one embodiment, the axis rotation of a respective spacer member is not fixed, and has freedom to move or translate. In one form, such movement or translation of the axis of rotation of a respective spacer member is substantially linear, but could also be, in another embodiment, non-linear. In one form, such movement or translation of the axis of rotation of a respective spacer member is in the vertical plane. In an embodiment, the scope of movement of the axis of rotation is constrained. Preferably it is constrained by travel being limited to movement within a slot.

In one embodiment, each spacer member is rotatably supported by a support structure.

In one embodiment, each spacer member comprises a projecting member which interacts with a channel or groove configured so as to limit the scope of rotational freedom of the spacer member about its axis of rotation. In one embodiment, the channel or groove is formed in a portion of the support structure.

In one embodiment, the support structure is configured in a columnar form aligned substantially with the vertical plane.

In one embodiment, the support structure is configured so as to rotatably support the plurality of spacer members. In one form, the plurality of spacer members are spaced from one another in a vertical manner.

In one embodiment, the support structure is configured so as to rotatably support a plurality of detent members, each detent member arranged so as to be operable with an associated spacer member.

In one embodiment, the support structure is configured so as to rotatably support more than one set of a plurality of detent members and associated spacer members, each detent member and associated spacer members of one set spaced vertically from another detent member and associated spacer member, each set of spacer members being disposed in side by side relation relative to another set of a plurality of detent members and associated spacer members.

In one embodiment, the support structure is configured so that each set of spacer members is offset from an adjacently disposed set of spacer members.

In one embodiment, the support structure is configured so that each set of detent members is offset from an adjacently disposed set of detent members.

In one embodiment, the support structure is configured so that respective axes of rotation of each spacer member of a set of spacer members is offset (for example, vertically) from respective axes of rotation of each spacer member of an adjacently disposed set of spacer members.

In one embodiment, the support structure is configured so that respective axes of rotation of each detent member of a set of detent members is offset (for example, vertically) from respective axes of rotation of each detent member of an adjacently disposed set of detent members.

In one embodiment, the support structure is configured so as to rotatably support two sets of a plurality of detent members and associated spacer members, each set being arranged in columnar form adjacent one another.

In one embodiment, the drive arrangement is configured for receiving drive from a drive unit for moving the body.

In one embodiment, the drive unit is provided in the form of a rotary device.

In one embodiment, the body is operably associated with a rail along which the body is moveable in first and second directions by way of the drive transfer arrangement. In one form, the rail is arranged substantially parallel with the columnar form of the support structure.

In one embodiment, movement of the body is constrained so as to be substantially aligned or parallel with an axis of the rail. In one embodiment, movement of the body is constrained so as align with an axis of movement substantially concentric with the axis of the rail. In one embodiment, the movement of the body is constrained by way of its engagement with the rail. In one form, the rail is aligned substantially in a vertical plane.

Rotation of a spacer member interacted with by the body toward or away from its first position depends on the direction of movement of the body.

In one embodiment, the body interacts with the plurality of spacer members sequentially when moving in the first direction along the rail, the interaction serving to move each of the spacer members interacted with to respective first positions.

In one embodiment, the body interacts with the plurality of spacer members sequentially when moving in the second direction along the rail, the interaction serving to allow each of the spacer members interacted with to move away from respective first positions.

In one embodiment, first direction of movement of the body is substantially downwards along the rail, and the second direction of movement of the body substantially upwards along the rail.

In one embodiment, the body comprises a first side configured for interacting with a respective spacer member as the body moves, said interaction causing rotation of the relevant spacer member to or toward its respective first position.

In one embodiment, the first side of the body is configured having at least one surface portion which interacts with a portion of a spacer member in moving same to or toward its first position. In one form, said surface portion of the first side is substantially planar (but could be non-planar). In another form, said surface portion is arranged in angled relation relative to the direction the body moves when the first side interacts with the spacer member for moving same to or toward its respective first position.

In one embodiment, the configuration of the first side of the body is arranged so as to cause an interaction between said first side and the relevant spacer member as the body passes thereby which causes a portion of said spacer member to follow a path of movement operating to rotate said spacer member toward or away from its first position about its respective axis of rotation, depending on the direction of movement of the body.

In one embodiment, the body is formed having a wedge-like form. In this manner, the body is formed so as to taper from one portion thereof to another portion thereof.

In one embodiment, the body comprises a second side configured for interacting with a portion of the detent member for moving the detent member into a position in which the detent member provides support to an associated spacer member when in its respective first position.

In one embodiment, the second side of the body comprises a groove. In one form, said groove is shaped so as to provide a grooved path or channel. In this manner, the groove is configured so as to operate as a guide when interacting with said portion of the detent member for guiding movement of the detent member in moving same into a position for conferring support to an associated spacer member when in its first position.

In one embodiment, the groove is aligned generally with the path that the body travels. In one particular embodiment, the path of movement of the body aligns generally with a vertically plane or axis.

In one embodiment, the shape of respective first and second sides of the body are configured so as to facilitate the following of respective paths of movement by a spacer member and a detent member operably associated therewith relative to the body, in the movement each spacer member to its respective first position and the movement of the detent member to a position for holding the spacer member in its first position.

In one embodiment, the configuration of the second side of the body is arranged so as to cause an interaction between said second side and the detent member as the body passes thereby for causing a portion of said detent member to follow a path of movement operating to rotate said detent member toward or away from its respective spacer member support conferring position.

In one embodiment, movement of the detent member toward or away from its respective spacer member support conferring position depends on the direction of movement of the body.

In one embodiment, interactions between the body, a spacer member, and a detent member operable for providing support to said spacer member in its first position, occurs at about the same time as the body passes the relevant spacer member.

In one embodiment, the interaction between the first side of the body with a spacer member (for causing movement of the spacer member toward its respective first position) and the interaction between the second side of the body with the detent member operably associated with the spacer member (for causing movement of the detent member toward a position for supporting the spacer member when moved to its first position) occurs at about the same time as the body passes the relevant spacer member.

In one embodiment, the detent member comprises a body rotatable or pivotable about a respective axis of rotation.

In one embodiment, the body of the detent member comprises a portion configured for engaging a portion of a spacer member associated therewith for supporting said spacer member in its first position.

In one embodiment, the portion of the detent member which engages the portion of the spacer member for conferring support thereto is distal of the axis of rotation of the detent member.

In one embodiment, rotation of a respective detent member about its axis of rotation in a first direction of rotation moves said detent member toward a position for supporting a corresponding spacer member operably associated therewith in its first position, and rotation of the respective detent member about its axis of rotation in a second direction of rotation moves said detent member away from said support conferring position.

In one embodiment, the detent member comprises a projecting member which extends from its body so as to interact with the groove of the second side of the body.

In one embodiment, the projecting member of the detent member is dimensioned so as to be received within the groove of the second side of the body.

In one embodiment, one or more edges defining the groove are configured so as to, when interacting with the projecting member of the detent member, bias the movement of the projecting member so as to cause the detent member to rotate about its axis of rotation.

In one embodiment, the detent member comprises a further projecting member which interacts with a channel or groove configured so as to limit the scope of rotational freedom of the detent member about its axis of rotation. In one embodiment, said channel or groove is formed in a portion of the support structure.

In one embodiment, the first and second sides of the body are configured so that the interaction between the second side of the moving body and the detent member biases the detent member to or toward a position for supporting the spacer member at about the time the interaction between the first side of the moving body and the spacer member completes movement of the spacer member to its first position.

In one embodiment, the first and/or seconds sides of the body are integral therewith.

In one embodiment, the first and/or second sides of the body are formed separately of the body and connectable therewith (in a permanent or temporary manner).

In one embodiment, the drill rod spacer mover is mounted with an existing drill rod storage assembly (such as for example, as a retrofit assembly/installation).

In one embodiment, the drive unit is mounted with a frame.

In one embodiment, for the case where more than one drill rod spacer is operable (e.g. with a drill rod storage assembly) and arranged cooperatively to move the drill rod spacers, the drive unit is mounted with respect to the support structure(s) and arranged operable for driving movement of their respective bodies. In this manner, only a single rotary device is required for operation of the relevant spacer members for a single drill rod storage assembly.

In one embodiment, the rotary device is pneumatic in nature/operation.

In one embodiment, the rotary device comprises a reduction gearbox, or is configured so as to be operably associated with a reduction gearbox.

In one embodiment, the rotational speed of the rotary device is controlled by way of one or more directional valve units configured operable with an adjustable exhaust throttle.

In one embodiment, the transfer of drive from the drive unit is enabled using a chain/sprocket arrangement configured for transferring drive from the rotary device for moving/driving of a body of a respective drill rod spacer.

In one embodiment, the drive unit is arranged in operable association with a sensor configured for monitoring one or more operational characteristics of the drive unit. The operational characteristics may include, but are not limited to, position, speed, temperature, torque and pressure. Additionally, the sensor may monitor the operational characteristics of the drive unit for faults. An example of a fault being detected would be operation of the drive unit without movement of a respective spacer member. Alternatively, the control system may be completed using a mechanical method, such as a ratcheting system. The control unit may comprise entirely, or in part, a combination of both an electronic control system and a mechanical method In one form, the drive unit is arranged in operable association with a rotary encoder.

In one embodiment, the drill rod spacer mover is arranged in operable association with a control system for use in controlling operation of said spacer mover. In one embodiment, the control system comprises a programmable logic controller (PLC), a rotary encoder, a drive motor, such as, for example, a direction control valve, motor and an input device, such as, for example, a button, switch or joystick. Operation of the input device is detected by the PLC which in turn provides power to the motor causing it to operate the drive arrangement to move the body in a direction according to the input device operated. In this manner, for example, an 'up' button will move the spacers to 'fold up' and a 'down' button will move the spacers to 'fold down', one row at a time.

In one embodiment, the drive arrangement comprises a drive unit for powering the drive arrangement. In one embodiment, the drive arrangement comprises a drive transfer unit configured operable for receiving drive for moving the body to interact with one of the spacer members.

In one embodiment, the interaction of the body with the or each spacer member comprises the body contacting a lobe of the respective spacer member.

According to a second principal aspect, there is provided a drill rod storage assembly for storing a plurality of drill rods whereby adjacent drill rods are separated by a spacer member, the drill rod storage assembly comprising:

- one or more drill rod spacer assemblies operable with a plurality of spacer members arranged in spaced relation,
- each drill rod spacer assembly comprising a body moveable along the spacing of the spacer members,
- each body configured for interacting with a respective spacer member while moving so as to move same to a respective first position for being supported thereat when the body moves to interact with another one of the spacer members.

In one embodiment, more than one drill rod spacer assemblies are arranged so as to form a drill rod spacer mover assembly. In one form, said drill rod spacer assemblies are arranged in series and respective bodies thereof are moved by way of a drive unit.

In one embodiment, movement of the bodies is synchronized so that the movement of one of said bodies is substantially the same as that of another of said bodies. Alternatively, movement of respective bodies could be arranged so as to be different from each other (for example, in an offset manner).

In one embodiment, first and second drill rod spacer assemblies are arranged in spaced relation along a longitudinal axis of the drill rod support assembly. Respective longitudinal axes of each drill rod align substantially parallel with said longitudinal axis of the drill rod support assembly when admitted for storage by the drill rod storage assembly. In one form, the longitudinal axis of the drill rod support assembly aligns substantially parallel with a horizontal axis and/or the ground.

In one embodiment, the or each of the drill rod spacer assembly comprise an embodiment of a drill rod spacer mover as described herein.

According to a third principal aspect, there is provided a mover for moving spaced apart drill rod spacers, the mover comprising:

a movable body configured to respectively move each of the drill rods spacers to a respective first position as the body moves in a first direction past the respective drill rod spacer, and the movable body is further configured to cause the respective drill rod spacer to respectively be able to move to a respective second position as the body moves past the respective drill rod spacer in a second direction;

a detent for each drill rod spacer configured to retain the respective drill rod spacer in the first position after the body has activated the respective drill rod spacer in the first direction and further configured to release the retaining of the respective drill rod spacer when the body respectively moves past each drill rod spacer in the second direction.

According to a fourth principal aspect, there is provided a drill rod spacer assembly comprising:

a plurality of spacer members each movable to a first position, a drive transfer unit configured operable for receiving drive for moving a body into contact with one of the spacer members, the contact and further movement of the body causing the spacer member to pivot to its respective first position.

According to a fifth principal aspect, there is provided a drill rod spacer assembly comprising:

a plurality of spacer members each movable to a respective first position, a drive transfer unit configured operable for receiving drive for moving a body, the body having a portion configured so as to facilitate following of a path of movement by each of the spacer members when interacted with, in turn, by the moving body for moving each spacer member to its respective first position.

According to a sixth principal aspect, there is provided a drill rod spacer assembly comprising:

a plurality of spacer members each movable to/from a first position, a drive transfer unit configured operable for receiving drive for moving a body in first and second directions, the body having at least two shaped sides, the shape of each side facilitating following of respective paths of movement relative to the body, at least one detent member arranged in operable association with one of said spacer members for supporting said one spacer member in its first position following movement thereto by way of an interaction between a first of said shaped sides and a portion of the spacer member in accordance with a first path of relative movement as the body is driven in one of said first, second directions, the detent member being moveable toward or away from the spacer member support conferring position by way of an interaction between the detent member and a second of said shaped sides of the body in accordance with a second path of relative movement as the body is driven in the first, second directions respectively.

According to a seventh principal aspect, there is provided a method for forming a drill rod spacer assembly comprising:

configuring a plurality of spacer members so that each are movable to a first position, configuring a drive arrangement for receiving drive for use in moving a body, the body configured for interacting with a respective one of the spacer members while moving so as to move same to its first position, configuring a detent member so as to be operable for supporting the respective spacer member in its first position when the body moves to interact with another one of the spacer members.

According to an eighth principal aspect, there is provided a method for forming a drill rod spacer mover comprising:

configuring a plurality of spacer members so that each are movable to a first position, configuring a drive arrangement for moving a body into contact with one of the spacer members, the contact and further movement of the body causing the spacer member to pivot to its respective first position.

In an embodiment, there is provided a method for forming a drill rod storage assembly for storing a plurality of drill rods whereby adjacent drill rods are separated by a spacer member, the drill rod support assembly comprising:

configuring a plurality of drill rod spacer assemblies described above so as to be longitudinally spaced apart relative to the length of the drill rods when stored in the drill rod storage assembly, such that the drill rod spacer assemblies cooperatively move respective longitudinally spaced apart drill rod spacers to their respective first positions.

According to a further principal aspect, there is provided a method of operating any embodiment of a drill rod spacer assembly arranged in accordance with the drill rod spacer assembly of any of the principal aspects described.

According to a further principal aspect, there is provided a method of associating or assembling with a drill rod storage assembly, any embodiment of a drill rod spacer assembly arranged in accordance with the drill rod spacer assembly of any of the principal aspects described.

According to a further principal aspect, there is provided a method of operating any embodiment of a drill rod spacer assembly arranged in accordance with the drill rod spacer assembly of any of the principal aspects described, that is arranged in operable association with a drill rod storage assembly for removal/admission of a drill rod for storage/operational purposes.

Embodiments of the drill rod spacer mover arranged in accordance with the principles described herein may realize a number of advantages including, but not limited to, any of the following

- a means of placing/removing drill rod spacer members that seeks to eliminate manual intervention of human operators (e.g. drillers/offsiders);
- improves reliability over existing systems;
- allows for constraint in or reduction in dimensions thereby limiting or reducing the required space for use;
- reduces complexity of existing systems.

Various principal aspects described herein can be practiced alone or combination with one or more of the other principal aspects, as will be readily appreciated by those skilled in the relevant art. The various principal aspects can optionally be provided in combination with one or more of the optional features described in relation to the other principal aspects. Furthermore, optional features described in relation to one example (or embodiment) can optionally be combined alone or together with other features in different examples or embodiments.

For the purposes of summarizing the principal aspects, certain aspects, advantages and novel features have been described herein above. It is to be understood, however, that not necessarily all such advantages may be achieved in accordance with any particular embodiment or carried out in a manner that achieves or optimizes one advantage or group of advantages as taught herein without necessarily achieving other advantages as may be taught or suggested herein.

It is to be understood that each document, reference, patent application or patent cited in this text is expressly incorporated herein in their entirety by reference, which means that it should be read and considered by the reader as part of this text. That the document, reference, patent application, or patent cited in this text is not repeated herein is merely for reasons of conciseness.

Furthermore, in this specification, where a literary work, act or item of knowledge (or combinations thereof), is discussed, such reference is not an acknowledgment or admission that any of the information referred to formed part of the common general knowledge as at the priority date of the application. Such information is included only for the purposes of providing context for facilitating an understanding of the inventive concept/principles and the various forms or embodiments in which those inventive concept/principles is/are exemplified.

BRIEF DESCRIPTION OF THE DRAWINGS

In order to provide a better understanding of the present invention, a preferred embodiment will now be described in detail, by way of example only, with reference to the accompanying drawings.

DETAILED DESCRIPTION OF PREFERRED EMBODIMENTS

Figure 1A:
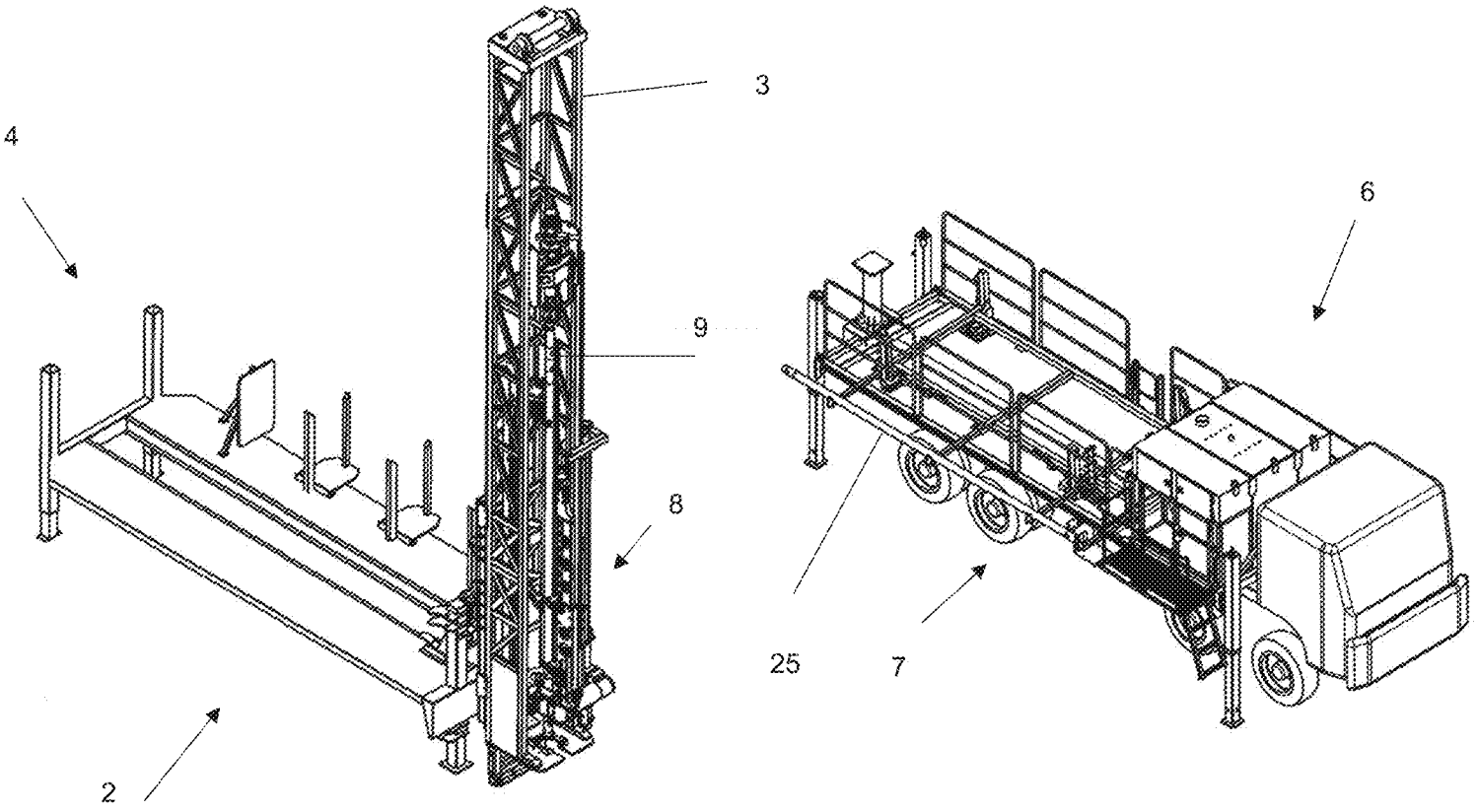
FIG. 1A shows a perspective view of a drill rod carrying truck and a drilling rig, on which is an existing drill rod storage assembly.

In the figures, like elements are referred to by like numerals throughout the views provided. The skilled reader will appreciate that elements in the figures are illustrated for simplicity and clarity and have not necessarily been drawn to scale. For example, the dimensions and/or relative positioning of some of the elements in the figures may be exaggerated relative to other elements to facilitate an understanding of the various embodiments exemplifying the principles described herein. Also, common but well understood elements that are useful or necessary in a commercially feasible embodiment are often not depicted in order to provide a less obstructed view of these various embodiments. It will also be understood that the terms and expressions used herein adopt the ordinary meaning as is accorded to such terms and expressions with respect to their corresponding respective areas of inquiry and study except where specific meanings have otherwise been set forth herein.

It should be noted that the figures are schematic only and the location and disposition of the components can vary according to the particular arrangements of the embodiment (s) as well as of the particular applications of such embodiment(s).

Specifically, reference to positional descriptions, such as 'lower' and 'upper', and associated forms such as 'uppermost' and 'lowermost', are to be taken in context of the embodiments shown in the figures, and are not to be taken as limiting the scope of the principles described herein to the literal interpretation of the term, but rather as would be understood by the skilled reader.

Embodiments described herein may include one or more range of values (e.g. size, displacement and field strength etc.). A range of values will be understood to include all values within the range, including the values defining the range, and values adjacent to the range which lead to the same or substantially the same outcome as the values immediately adjacent to that value which defines the boundary to the range.

Other definitions for selected terms used herein may be found within the detailed description and apply throughout. Unless otherwise defined, all other scientific and technical terms used herein have the same meaning as commonly understood to one of ordinary skill in the art to which the embodiment(s) relate.

DETAILED DESCRIPTION OF EMBODIMENT(S)

The words used in the specification are words of description rather than limitation, and it is to be understood that various changes may be made without departing from the spirit and scope of any aspect of the invention. Those skilled in the art will readily appreciate that a wide variety of modifications, alterations, and combinations can be made with respect to the above described embodiments without departing from the spirit and scope of any aspect of the invention, and that such modifications, alterations, and combinations are to be viewed as falling within the ambit of the inventive concept.

Throughout the specification and the claims that follow, unless the context requires otherwise, the word "comprise" or variations such as "comprises" or "comprising", will be understood to imply the inclusion of a stated integer or group of integers but not the exclusion of any other integer or group of integers.

Furthermore, throughout the specification and the claims that follow, unless the context requires otherwise, the word "include" or variations such as "includes" or "including", will be understood to imply the inclusion of a stated integer or group of integers but not the exclusion of any other integer or group of integers.

FIG. 1A shows a drilling rig 2 comprising a mast 3. The drilling rig 2 has a drill rod storage assembly 4 for use in storing drill rods 25 used in a drilling operation. Also shown is a drill rod truck 6 that has a drill rod storage assembly 7 (shown carrying a drill rod 25) also for use in storing drill rods 25 used in the drilling operation. The drill rod truck 6 is positioned relative to the drilling rig 2 so that the drill rod storage assembly 7 is close to the mast 3. It will be appreciated that drill rod storage assemblies 4, 7 will usually hold many drill rods 25 that are able to be used in the drilling operation. Either or both of the drill rod storage assemblies 4, 7 may be provided in the form of a bin.

The drilling rig 3 comprises a drill rod handler 8 for taking a drill rod 25 from either drill rod storage assembly 4 or 7 and then positioning the taken drill rod 25 in an operational position relative to the mast 3 for use in the drilling operation (as indicated by 9). The drill rod handler 8 is also used for taking a drill rod 25 from the operational position and then placing it in either drill rod storage assembly 4 or 7 once it is no longer required in the drilling operation. The taking or returning of drill rods 25 to or from the drill rod storage assemblies 4, 7 may be repeated as required. The drill rod handler 8 is akin to that described in WO2019/028518), the content of which is incorporated herein by reference in its entirety.

In the storing of the drill rods 25 in any of the drill rod storage assemblies 4, 7, layers of drill rods 25 are separated by spacer members, often referred to as gluts—which are used to assist in the removal/return of the drill rods 25 to the relevant drill rod storage assembly by horizontally spacing layers of stacked drill rods 25.

Referring to FIGS. 1B to 19 there is shown a drill rod storage assembly 5 (which may be supported on the ground, or on a drill rod truck) for use in storing drill rods 25 used in a drilling operation. The drill rod storage assembly 5 is arranged having one embodiment of a drill rod spacer assembly comprising a corresponding set of drill rod spacer members 20 and a mover arrangement 15 for moving the corresponding set of drill rod spacer members 20 arranged in accordance with the principles described herein.

Figure 1B:
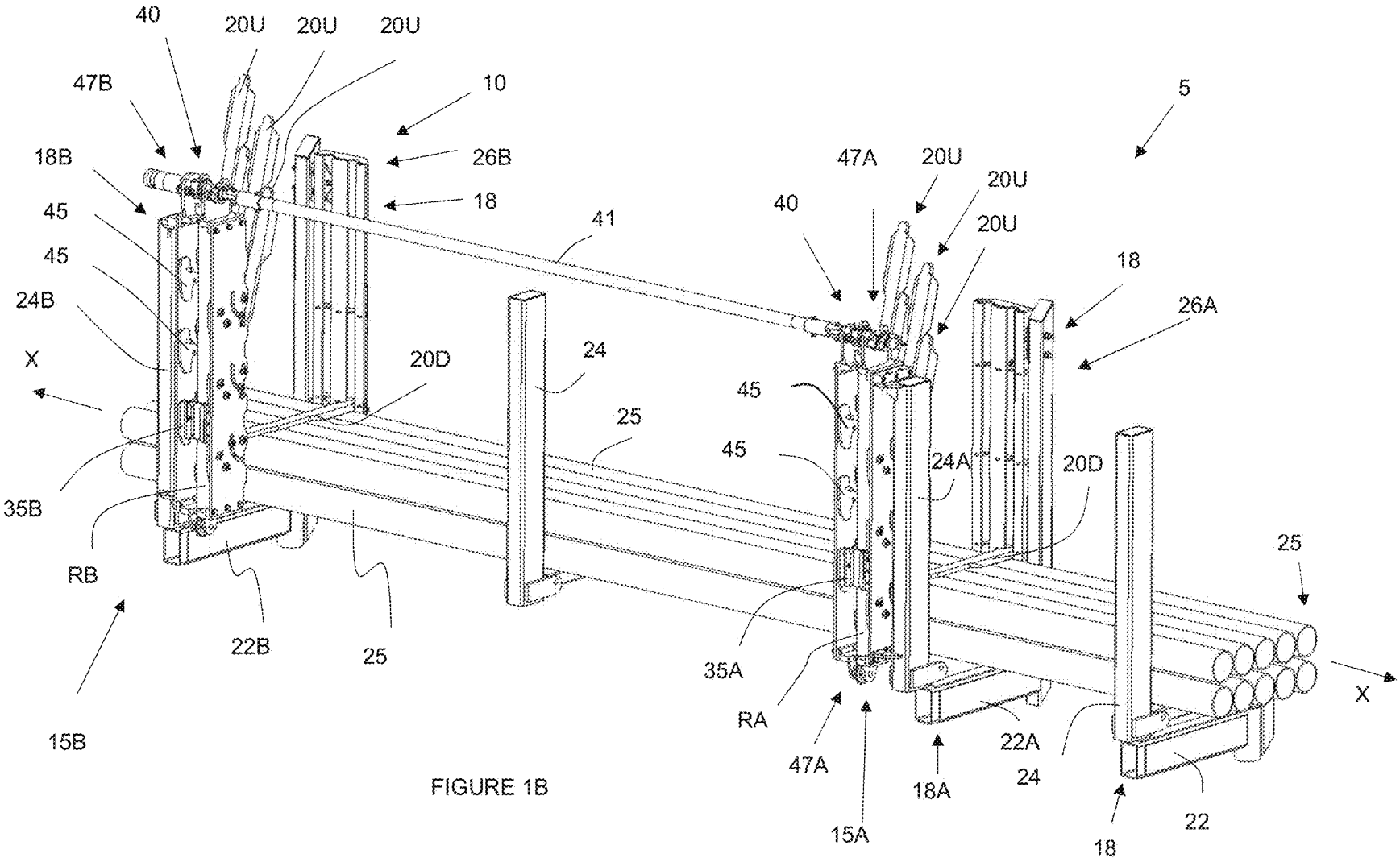
FIG. 1B shows a perspective view of one embodiment of a drill rod storage assembly incorporating one embodiment of a drill rod spacer mover arranged in accordance with the principles described herein.
Figure 2:
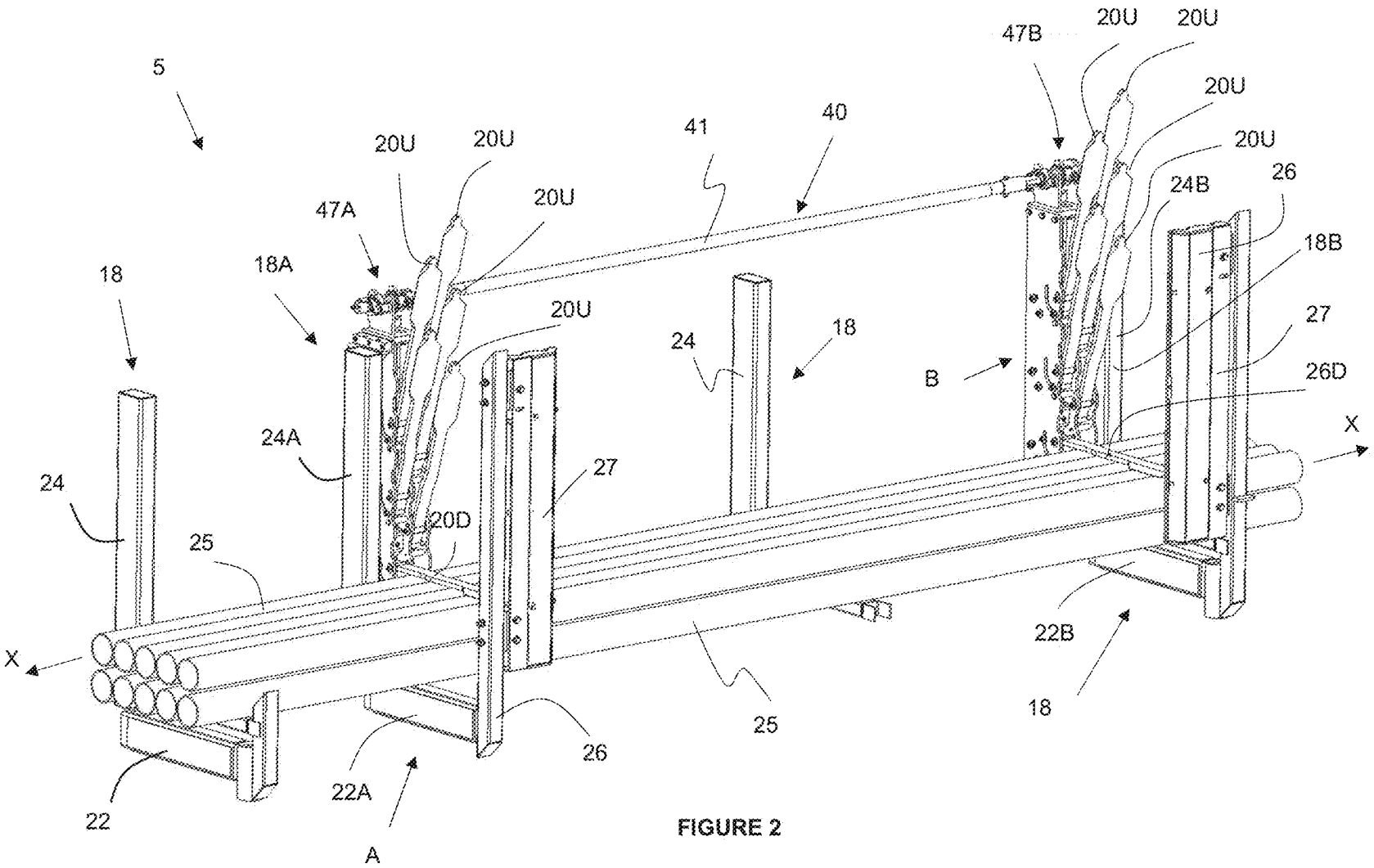
FIG. 2 shows a further perspective view of the embodiment of the drill rod spacer mover shown in FIG. 1.

The drill rod storage assembly 5 comprises a plurality of support frame assemblies 18 spaced along a longitudinal axis X for supporting a plurality of drill rods 25 arranged in layers atop a platform (not shown), which could be static or capable of tilting (to assist in the movement of the drill rods to a position accessible by, for example, a drill rod handler). Each of the support frame assemblies 18 comprise a generally horizontally aligned support member 22 connected (at an end thereof) with an upright member 24 in the manner shown in FIG. 1B. A number of the support frame assemblies 18 comprise additional upright assemblies 26 which oppose respective upright members 24 and operate to assist in contain the drills rods 25 in position in the drill rod storage assembly 5, as shown in FIGS. 1B and 2. In the present case, the drill rod storage assembly 5 is an existing drill rod storage assembly to which the drill rod spacer mover arrangement 15 is applied.

The drill rod spacer mover arrangement 15 comprises first $\mathbf{15}_A$, and second $\mathbf{15}_B$ drill rod spacer movers spaced from one another along the axis X, and each arranged in accordance with one embodiment of the principles described herein. The first drill rod spacer mover $\mathbf{15}_A$ is mounted with the support frame assembly $\mathbf{18}_A$, and the second drill rod spacer mover $\mathbf{15}_B$ is mounted with the support frame assembly $\mathbf{18}_B$.

Each of the first $\mathbf{15}_A$ and second 158 drill rod spacer movers are for moving the corresponding plurality of spacer members 20 for use in separating layers or rows of drill rods 25 when stored in the drill rod storage assembly 5. Each of the spacer members 20 are movable by the respective drill rod spacer mover $\mathbf{15}_A$, $\mathbf{15}_B$ to a first, generally 'upright' aligned, position (indicated by reference $\mathbf{20}_U$) for enabling access to the drill rods 25 of a layer or row under each moved spacer member (eg. for removal from the drill rod storage assembly 5 for operable use) by the drill rod handler, and a second, generally horizontally aligned, position (indicated by reference $\mathbf{20}_D$) for supporting a layer or row of the drill rods 25 (when not in, or awaiting, operable use) as shown.

The drill rod spacer mover arrangement 15 comprises a drive unit (not shown) configured operable for providing drive used for moving respective bodies $\mathbf{35}_A$, $\mathbf{35}_B$ of the first $\mathbf{15}_A$, and second $\mathbf{15}_B$ drill rod spacer movers along respective axes $M_A$, $M_B$ by way of a drive transfer arrangement 40. The bodies $\mathbf{35}_A$, $\mathbf{35}_B$ of respective drill rod spacer movers $\mathbf{15}_A$, $\mathbf{15}_B$ are configured for, while moving, interacting with the spacer members 20 rotatably supported by the respective drill rod spacer mover so as to sequentially move the respective spacer members 20 to their first positions $\mathbf{20}_U$. Each of the drill rod spacer movers $\mathbf{15}_A$, $\mathbf{15}_B$ comprise a plurality of detent members 45 configured operable for supporting an associated spacer member 20 in its first position 20*u* when the relevant body $\mathbf{35}_A$, $\mathbf{35}_B$ moves to interact with another spacer member 20. Each of the bodies $\mathbf{35}_A$, $\mathbf{35}_B$ are arranged in sliding relation via respective carriages $\mathbf{120}_A$, $\mathbf{120}_B$ with respective vertically aligned rails $R_A$, $R_B$ for facilitating movement of the bodies in the vertical plane along respective axes $M_A$, $M_B$. In this manner, the bodies $\mathbf{35}_A$, $\mathbf{35}_B$ interact sequentially with the spacer members 20 when caused to be moved along respective axes $M_A$, $M_B$ in either a downwards or an upwards direction (movement of the bodies $\mathbf{35}_A$, $\mathbf{35}_B$ therefore constrained by way of their sliding engagement with respective rails $R_A$, $R_B$).

Figure 6:
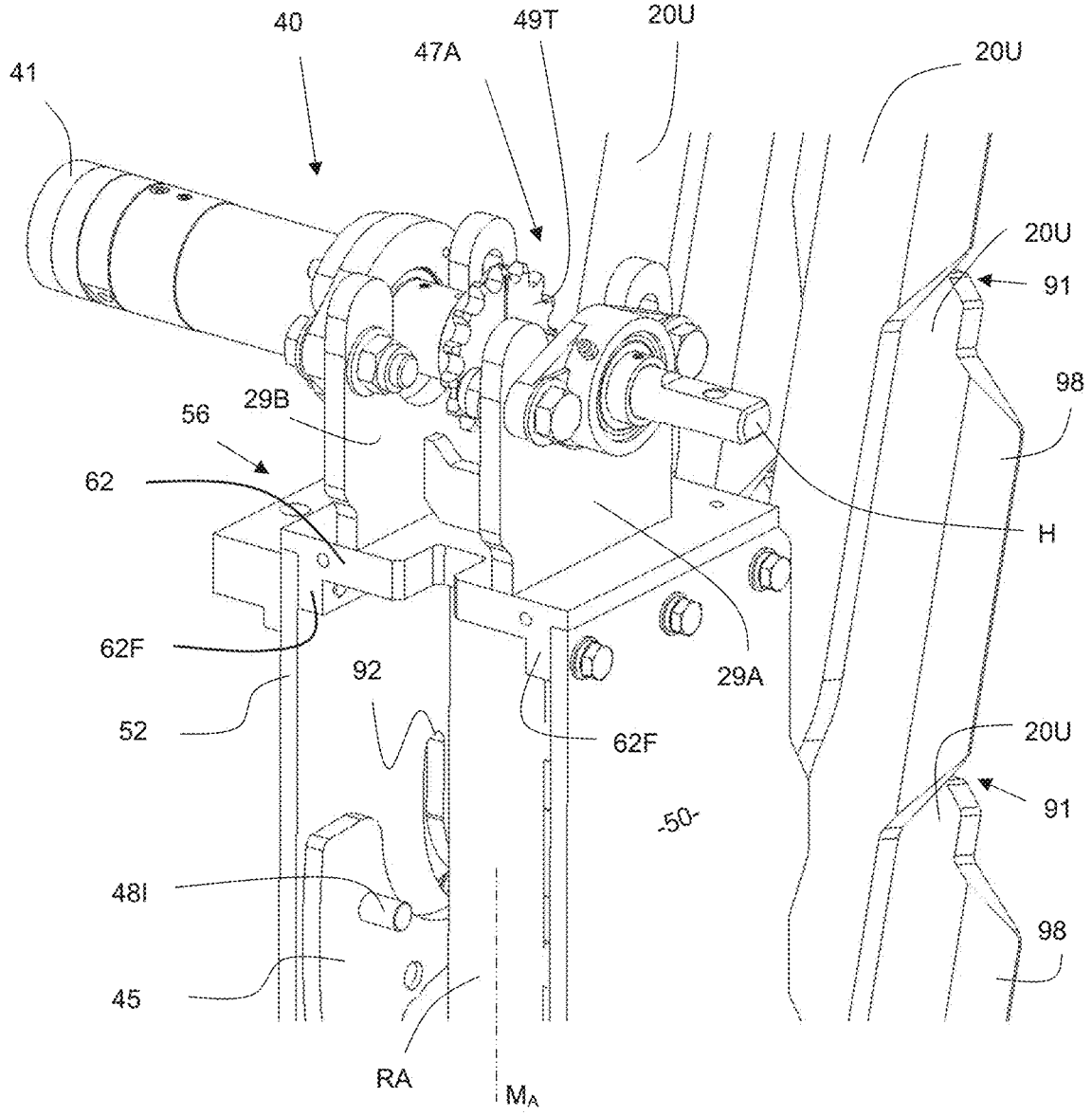
FIG. 6 shows a close-up perspective view of the region identified as C in FIG. 5.
Figure 7:
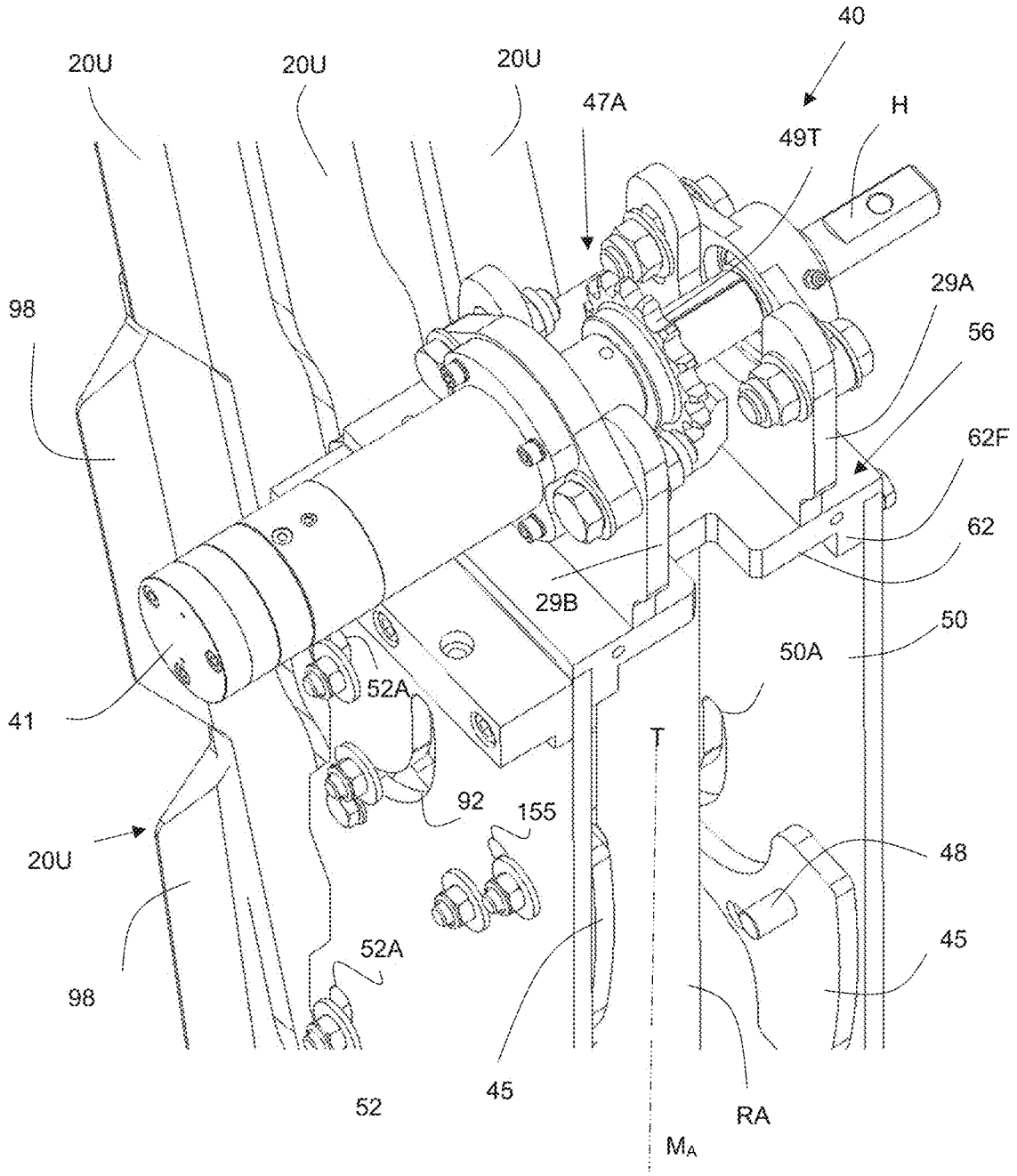
FIG. 7 shows a further close-up perspective view of the region shown in FIG. 6.

Drive may be provided by any appropriate drive providing device or unit and transferred to each of the drill rod spacer movers $\mathbf{15}_A$, $\mathbf{15}_B$ by way of the drive transfer arrangement 40 via a drive shaft 41 (see FIG. 1B and FIG. 6). Transfer of drive from the drive unit by way of the drive transfer arrangement 40 is enabled using chain/sprocket arrangements $\mathbf{47}_A$, $\mathbf{47}_B$ of respective drill rod spacer movers $\mathbf{15}_A$, $\mathbf{15}_B$, whereby each of the chain/sprocket arrangements are configured for receiving drive from the drive shaft 41 for moving/driving of the relevant body $\mathbf{35}_A$, $\mathbf{35}_B$. In this manner, multiple drill rod spacer movers can be driven by a single drive unit in a series type arrangement. Of course, the nominal output of the shared drive unit may need to be increased depending on the number of drill rod spacer movers used.

Figure 5:
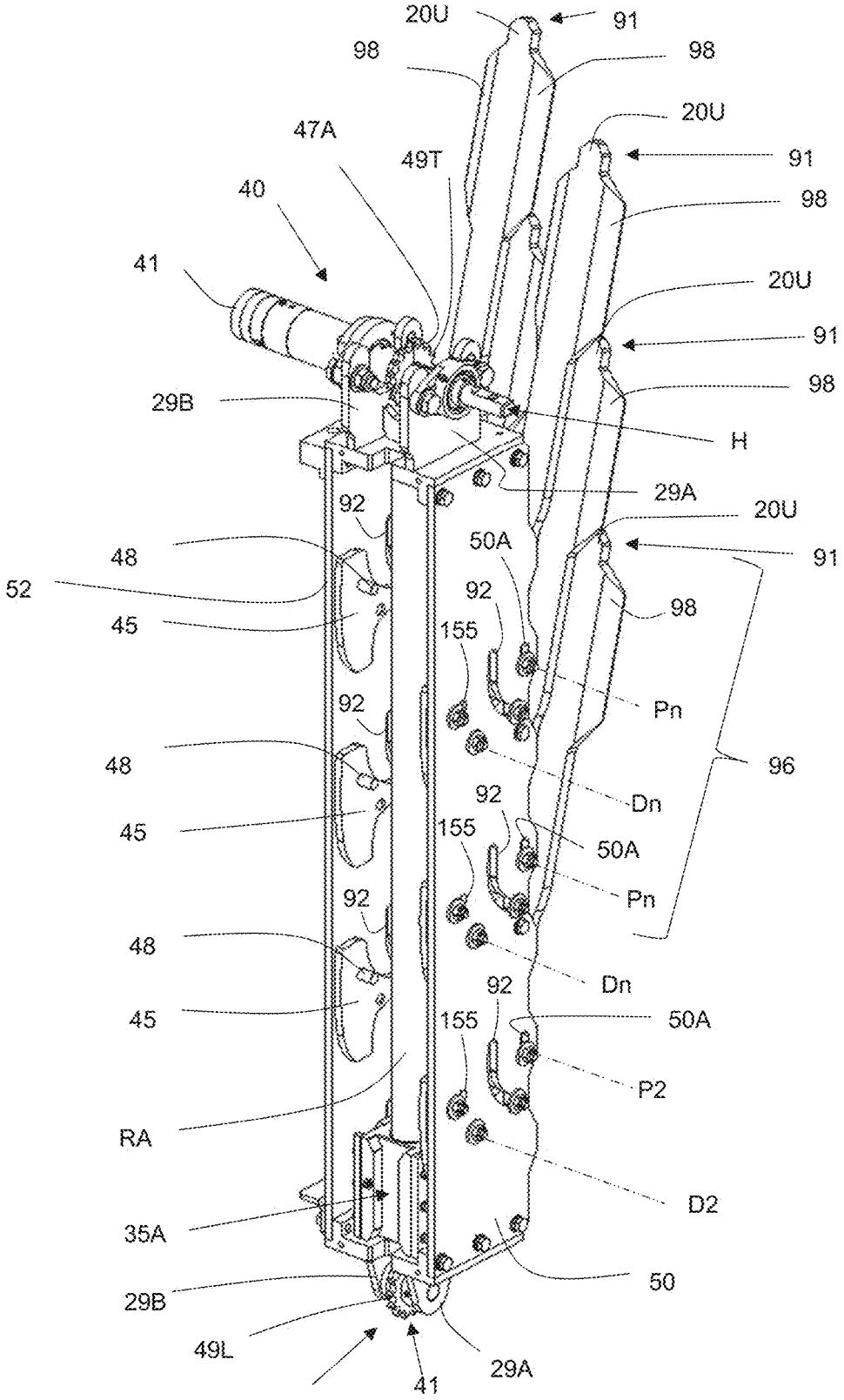
FIG. 5 shows a perspective view of the embodiment of the drill rod spacer mover shown in FIGS. 1 to 4.

Each of the chain/sprocket arrangements $\mathbf{47}_A$, $\mathbf{47}_B$ comprise a sprocket 49 arranged operable at each of the opposite ends of respective drill rod spacer movers $\mathbf{15}_A$, $\mathbf{15}_B$ for serving as turning points for a respective chain (not shown, but inferred) that is connected with respective bodies $\mathbf{35}_A$, $\mathbf{35}_B$ for driving/moving of the relevant body along the relevant axis $M_A$, $M_B$, as shown in FIG. 5.

As shown in FIGS. 5 to 9, each sprocket 49 is supported at opposite ends of respective drill rod spacer movers $\mathbf{15}_A$, $\mathbf{15}_B$ by way of respective spaced apart and parallel aligned support plates $\mathbf{29}_A$, $\mathbf{29}_B$ provided with respective top 56 (shown in FIGS. 5, 6, 7) and lower 58 (shown in FIGS. 5, 8, 9) end assemblies. A first sprocket $\mathbf{49}_T$ is rotatably supported at the upper end of each respective drill rod spacer mover $\mathbf{15}_A$, $\mathbf{15}_B$, and a second sprocket $\mathbf{49}_L$ is rotatably supported at a lower end of each respective drill rod spacer mover $\mathbf{15}_A$, $\mathbf{15}_B$. In operation, the drive shaft 41 is operably connected with the first sprockets $\mathbf{49}_T$ of respective drill rod spacer movers $\mathbf{15}_A$, $\mathbf{15}_B$ for driving the chain and the respective body $\mathbf{35}_A$, $\mathbf{35}_B$.

In one proposed embodiment, drive is provided to the drive shaft 41 by way of a rotary device that is pneumatic in operation and arranged operable with a gearbox (such as for example, a reduction gearbox) in order to drive the bodies $\mathbf{35}_A$, $\mathbf{35}_B$ at an appropriate speed. The rotational speed of the rotary device may be operable by way of one or more directional valve units configured operable with an adjustable exhaust throttle.

In one form, the drive unit is arranged in operable association with a sensor (shown in FIGS. 5 and 6) configured for monitoring one or more operational characteristics of the drive unit. In one embodiment, the sensor comprises a rotary encoder H for monitoring the number of rotations and/or the angular rotation of the drive shaft 41, and therefore enables a determination to be made of the position of each of the bodies $\mathbf{35}_A$, $\mathbf{35}_B$ along respective axes $M_A$, $M_B$. Furthermore, the drive unit providing drive to embodiments of the drill rod spacer mover configured in accordance with the principles described herein could be arranged in operable association with a controller thereby allowing the operation of the drive unit to be controlled or regulated, either directly or remotely using any control interface known to the skilled reader.

For the case shown in the Figures, where more than one drill rod spacer mover is operable (e.g. with a drill rod storage assembly 5), the drive unit is mounted with a frame or structure of one of the drill rod spacer movers (such as for example, the drill rod spacer mover $\mathbf{15}_B$) and arranged operable with the other drill rod spacer mover (e.g. $\mathbf{15}_A$) so as to provide drive for driving movement of the respective bodies $\mathbf{35}_A$, $\mathbf{35}_B$ (via the drive transfer arrangement 40). In this manner, only a single rotary device, and therefore only a single sensor, is required for moving of the spacer members 20 of both drill rod spacer movers $\mathbf{15}_A$, $\mathbf{15}_B$ for a single drill rod storage assembly 5.

Unless for convenience otherwise, for ease of explanation, description hereinafter is directed to the drill rod spacer mover $\mathbf{15}_A$. A substantial similar configuration is therefore implied for the drill rod spacer mover $\mathbf{15}_B$.

Figure 9:
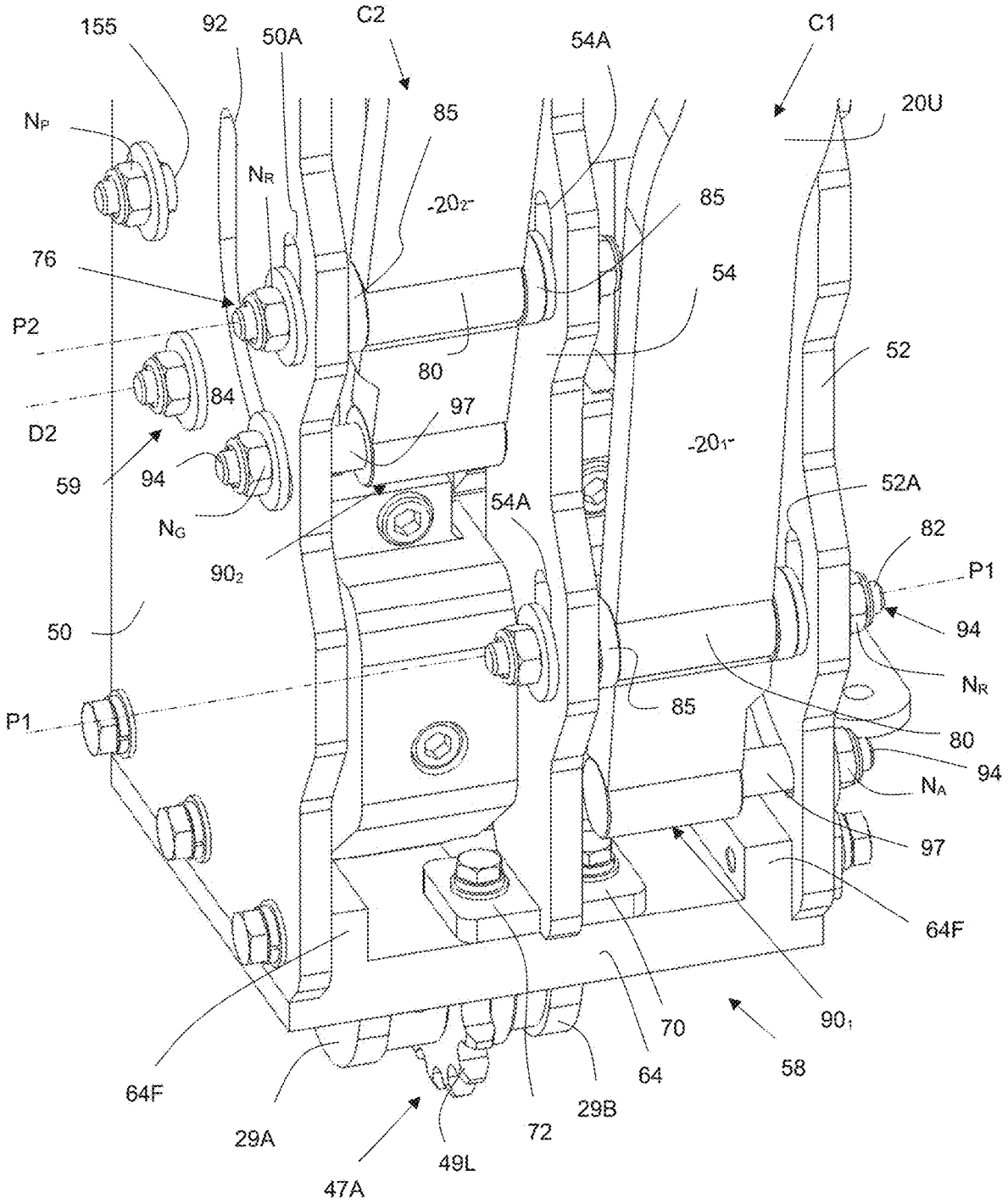
FIG. 9 shows a further close-up perspective view of the region shown in FIG. 8.

With reference to FIGS. 5 and 9, each of the drill rod spacer movers $\mathbf{15}_A$, $\mathbf{15}_B$ are configured of columnar form, whereby their respective constructions provide two parallel aligned columns $C_2$, $C_2$ each providing a plurality of spacer members 20 aligned in a substantially vertical manner in spaced relation. For the case of the drill rod spacer mover $\mathbf{15}_A$ (the structure of which is the same as for the drill rod spacer mover $\mathbf{15}_B$), the overarching columnar form is configured with side structures comprising vertically aligned side plates 50, 52 arranged in opposing spaced relation with one another, and each extending between the top end 56 assembly (comprising top end plate 62) to the lower end 58 assembly (comprising lower end plate 64). As shown in FIG. 6 (showing top end assembly 56) and FIG. 9 (showing lower end assembly 58), each of the respective end plates 62 and 64 are formed having parallel side flanges $\mathbf{62}_F$, $\mathbf{64}_F$ which allow the respective end assemblies 56, 58 to fasten (using bolts as shown) with respective ends of the side plates 50, 52 in the manner shown.

Intermediate (and generally central of) the vertically aligned plates 50, 52, and disposed substantially parallel therewith, is a central plate 54 which extends between the top 56 and lower 58 end assemblies. Opposite ends of the central plate 54, as shown in FIG. 9, locate between tab portions 70, 72, sets of which are fastened to respective end plates 62, 64 of the top 56 and lower 58 end assemblies respectively (the arrangement involving the top end assembly 56 is not shown but is the same as that for the lower end assembly 58) using fasteners (such as bolts). With specific reference to FIG. 9, by way of this configuration, the two generally parallel columns $C_1$, $C_2$, of vertically spaced spacer members 20 are provided.

Respective rails $R_A$, $R_B$ of the drill rod spacer movers $\mathbf{15}_A$, $\mathbf{15}_B$ are configured so as to run generally central of, and parallel with, the vertically aligned plates 50, 52 so as to facilitate movement of the respective bodies $\mathbf{35}_A$, $\mathbf{35}_B$ so that the relevant of its sides are capable of interacting with the detent members 45 and the spacer members 20 of both respective parallel columns $C_1$, $C_2$, as shown in FIG. 5.

Figure 8:
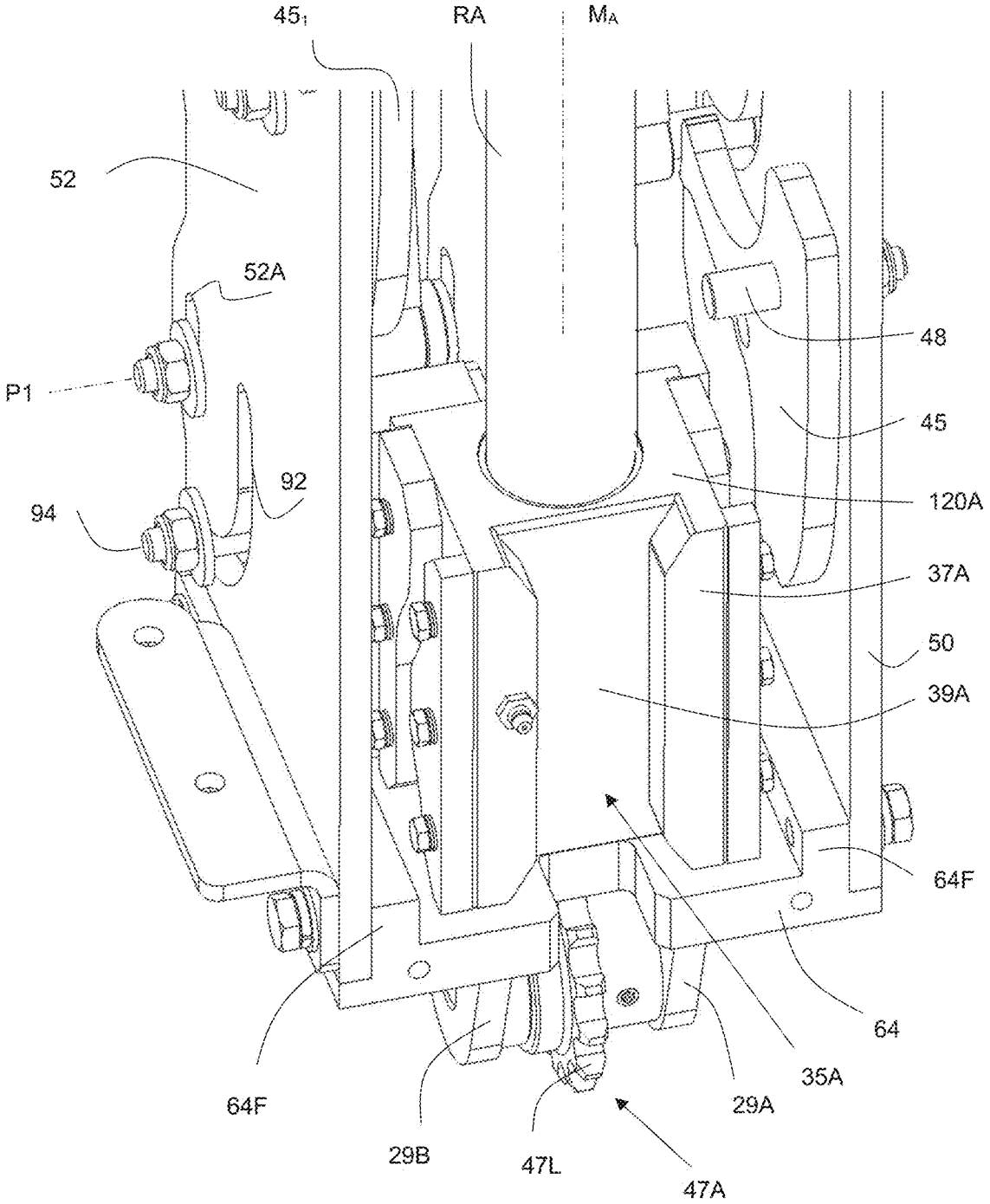
FIG. 8 shows a close-up perspective view of the region identified as D in FIG. 5.
Figure 13:
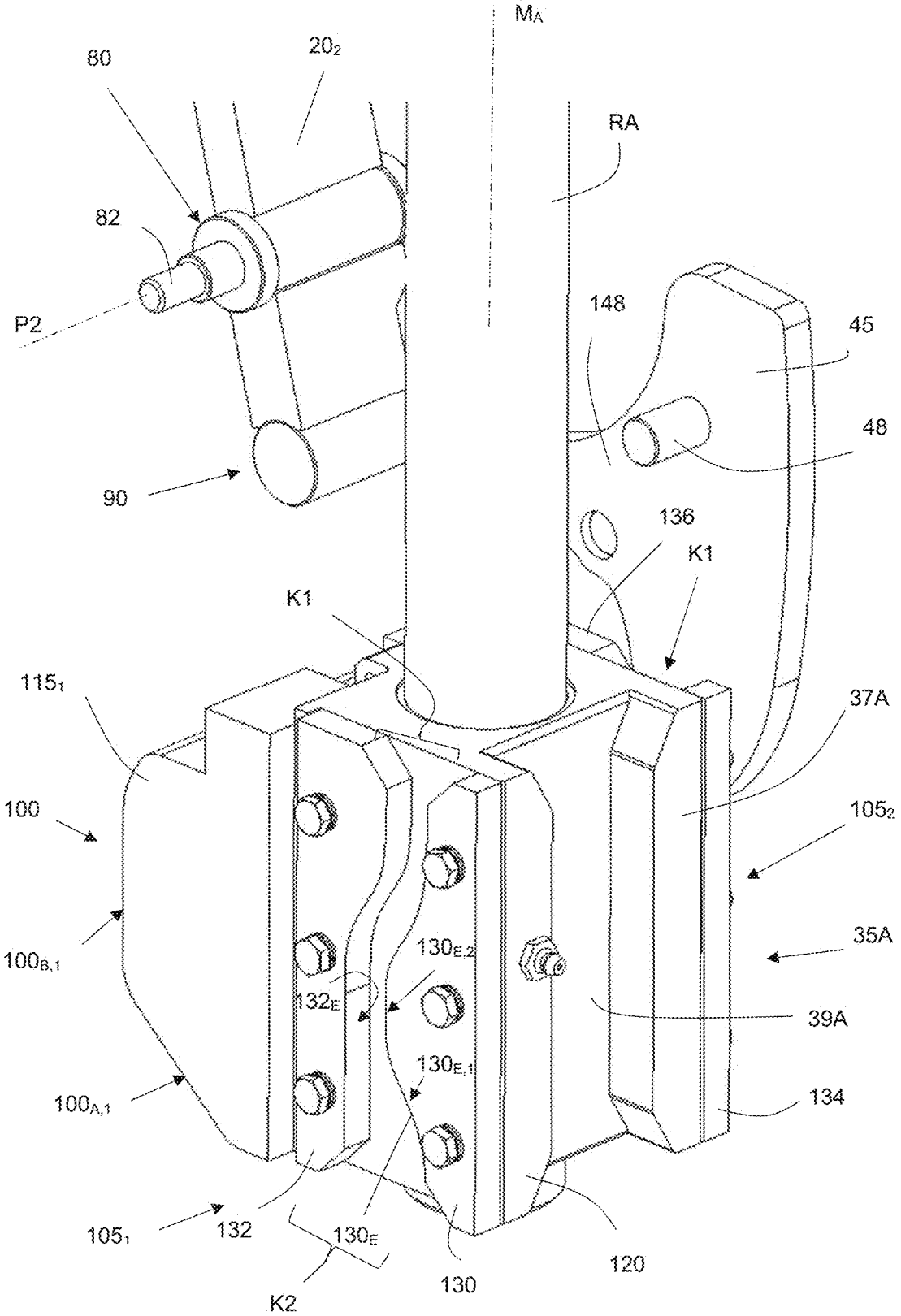
FIG. 13 shows another perspective view of that shown in FIG. 12, showing also portions of a spacer member and an associated detent member.

As can be seen in FIG. 8 and FIG. 13, the respective bodies $\mathbf{35}_A$, $\mathbf{35}_B$ are exemplified by way of being formed about respective carriages $\mathbf{120}_A$, $\mathbf{120}_B$ which slide along respective rails $R_A$, $R_B$. Each of the carriages $\mathbf{120}_A$, $\mathbf{120}_B$ comprise eyelets $E_1$ (shown located at the upper end of the carriage $\mathbf{120}_A$), $E_2$ (obscured from view in the Figures but located at the lowermost end of the carriage $\mathbf{120}_A$ opposite to the position of eyelet $E_1$) which connect with respective ends of the relevant chain operating with the respective chain/sprocket arrangement $47_A$, $47_B$. Respective sides $37_A$, $37_B$ of the bodies $35_A$, $35_B$ comprise respective channels $39_A$, $39_B$ through which respective chains may operate.

Each spacer member 20 is arranged so as to rotate or pivot about a respective axis of rotation $P_n$ (the subscript n referring to the relevant spacer member 20) in moving between its first $20_U$ and second $20_D$ positions. The axis of rotation $P_n$ of each spacer member 20 is provided near (or inward of) respective ends 90 (of rounded form) which interact with the relevant passing body $35_A$, $35_B$ as shown in FIG. 9.

Enablement of rotation of each spacer member 20 about its axis of rotation $P_n$ is configured so as to be of sufficient structural capacity for allowing the drill rods 25 of a layer/row to be supported by the relevant spacer member 20 along the portion 96 when in the second position $20_D$.

As shown clearly in FIGS. 5 and 9, each of the spacer members 20 relating to columns $C_1$, $C_2$ are rotatably supported by either of the vertically aligned plates 50, 52, and the central plate 54 so that each spacer member 20 is able to rotate or pivot about its respective axis. The respective axes of rotation $P_n$ of the spacer members 20 of column $C_1$ (which are spaced along the length of the vertically aligned plate 52) are offset from respective axes of rotation $P_n$ of the spacer members 20 of column $C_2$ (which are spaced along the length of the vertically aligned plate 50). The use of the parallel column configuration and the offset nature of the respective axes of rotation $P_n$ of each spacer member 20 allows for a plurality of layers of drill rods 25 to be stored by the drill rod storage assembly 5.

Figure 3:
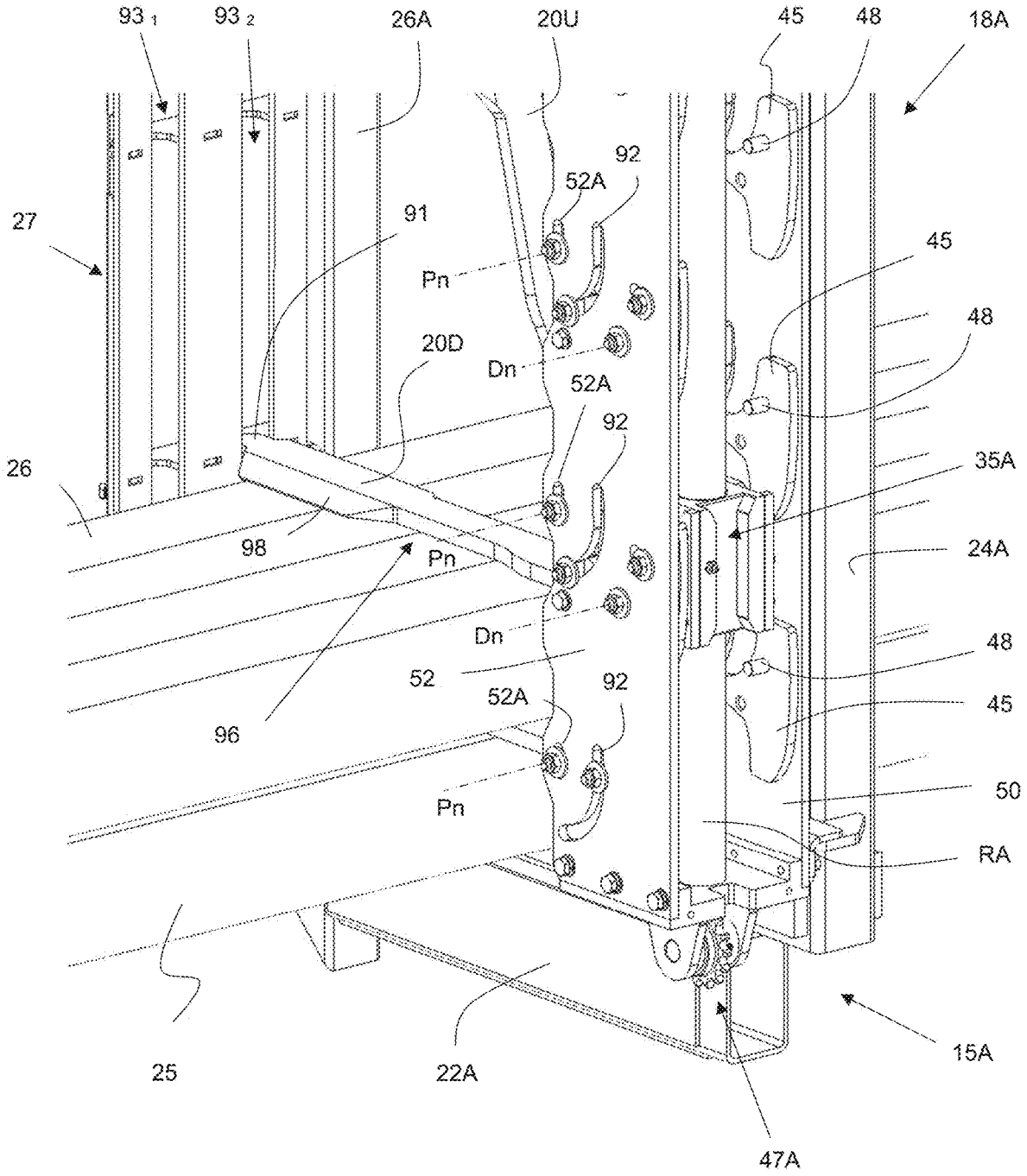
FIG. 3 shows a perspective view of the region identified as A in FIG. 1.

As shown in FIGS. 3 and 5, each of the detent members 45 relating to columns $C_1$, $C_2$ are rotatably supported by respective vertically aligned plates 50, 52 so that each detent member 45 is able to rotate or pivot about its respective axis $D_n$ (the subscript n referring to the relevant detent member) relative to its associated spacer member 20. Like with the spacer members 20, the axes of rotation $D_n$ of respective detent members 45 are spaced (so as to accord with the offset nature of the axes of rotation $P_n$ of the spacer members 20) along the length of the relevant of the vertically aligned plates 50, 52. Furthermore, the axes of rotation $D_n$ of respective detent members 45 rotatably supported by the vertically aligned plate 52 (of column $C_1$) are offset from the axes of rotation $D_n$ of respective detent members 45 rotatably supported by the vertically aligned side plates 50 (of column $C_2$).

Figure 10:
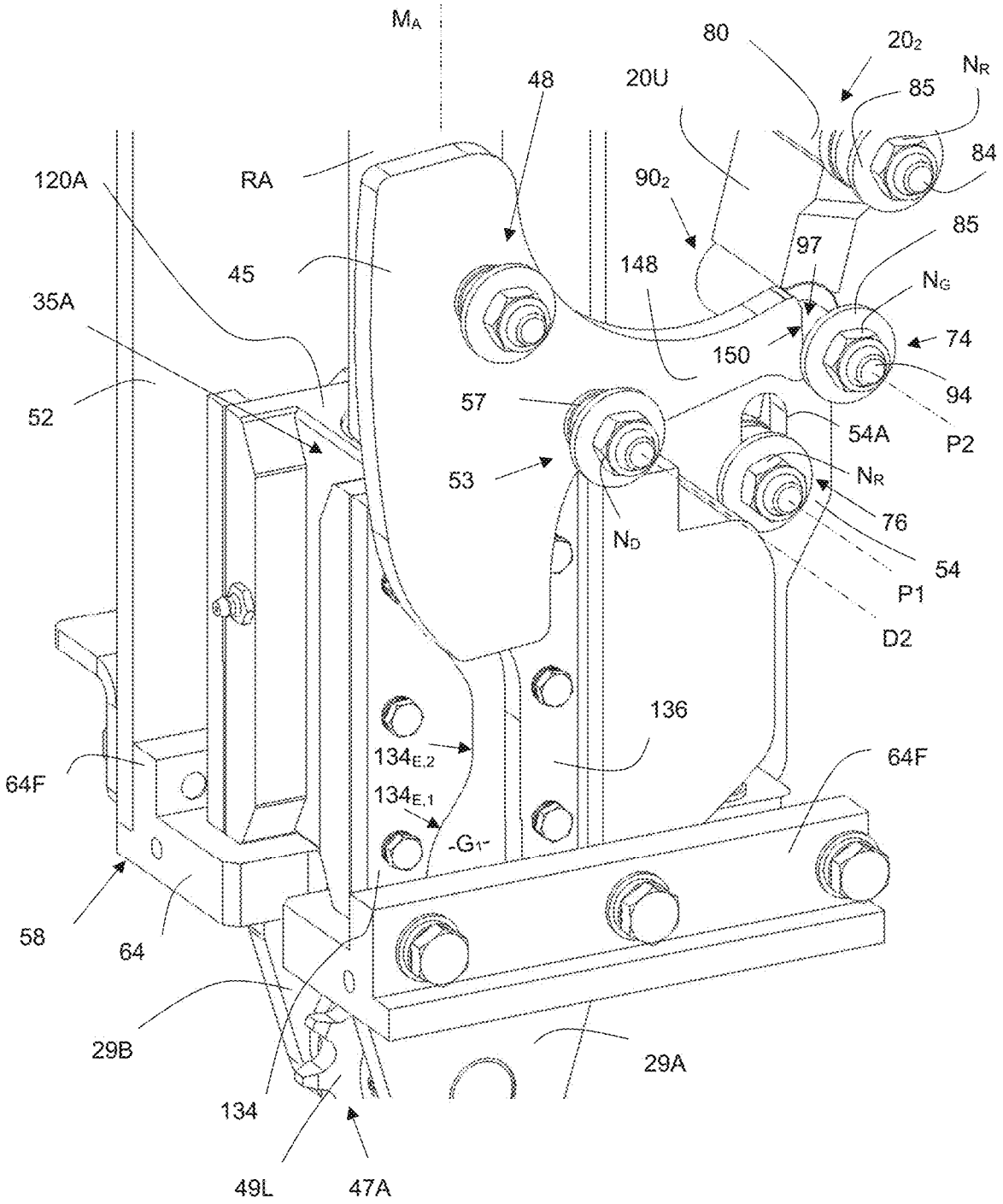
FIG. 10 shows another close-up perspective view of the region shown in FIGS. 8 and 9 (with support member of the drill rod spacer mover omitted for clarity)
Figure 11:
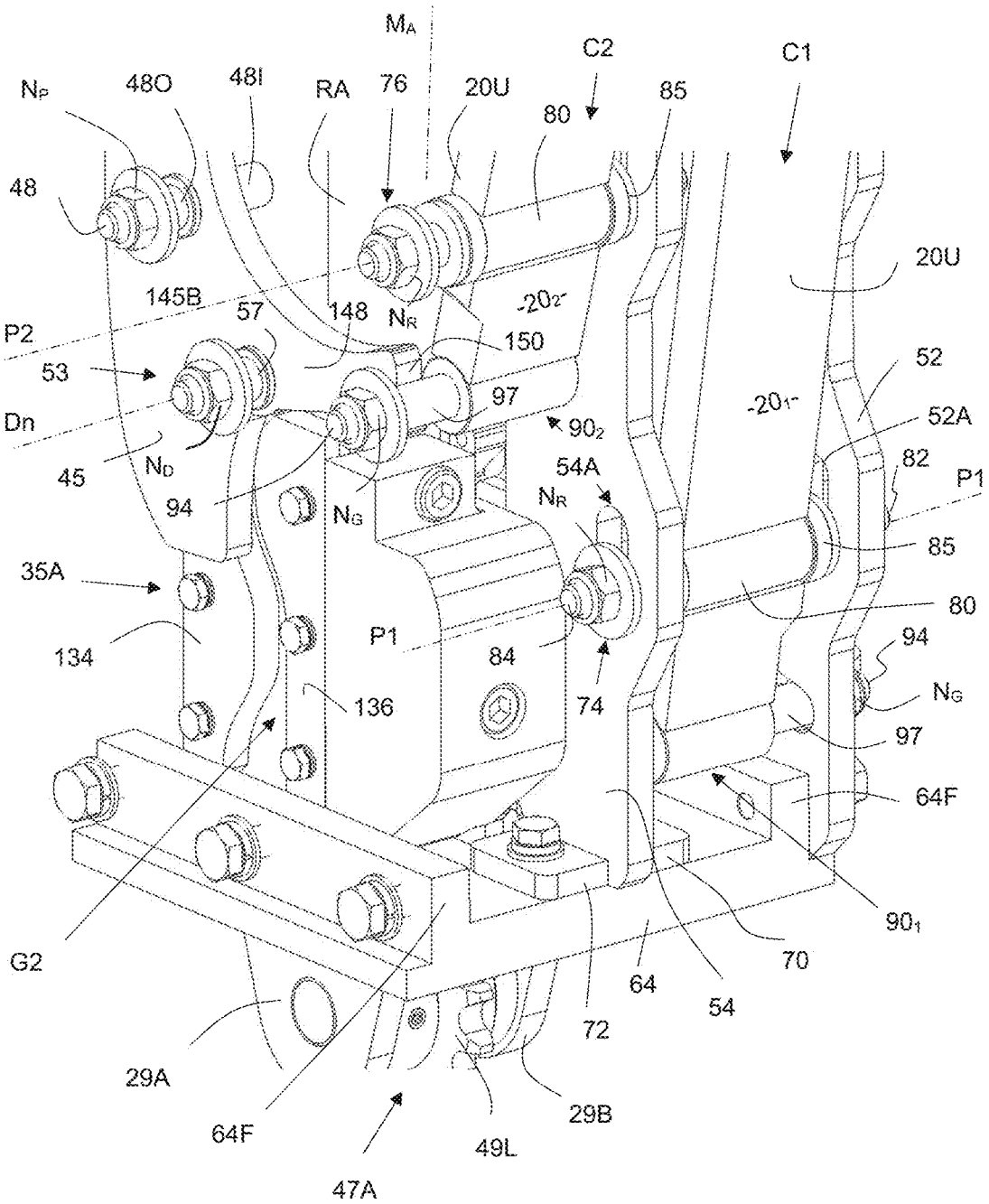
FIG. 11 shows another close-up perspective view of the region shown in FIG. 10.

Rotation of each detent member 45 is enabled by way of a pin assembly 53 comprising a shaft member 57 extending from the detent member 45 through an aperture 59 (the position of aperture 59 inferred in FIG. 9) formed in the relevant of the vertically aligned plates 50, 52 (as shown in FIGS. 10 and 11). An end of the shaft member 57 is provided with a thread on its external surface that is engageable with a nut $N_D$. The skilled reader will appreciate that rotational support of each detent member 45 by respective vertically aligned plates 50, 52 could be achieved in various ways.

As the skilled reader will appreciate, the positioning of any detent member 45 and its associated spacer member 20 can vary relative to its supporting vertically aligned side plates 50, 52 provided that each (the detent member 45 and its associated spacer member 20) can be operated by its relevant body $35_A$, $35_B$ so that the spacer member 20 can be moved to its first position $20_U$, and the associated detent member 45 can be moved to its support conferring position (by way of the respective body $35_A$, $35_B$), so as to support its associated spacer member 20 in its first position $20_U$.

As shown in FIG. 9, which shows the rotatable support arrangement used for all spacer members 20 supported by the drill rod spacer movers $15_A$, $15_B$, the lower two spacer members $20_1$, $20_2$ of the drill rod spacer mover $15_A$ for each of the columns $C_1$, $C_2$ are rotatable about respective axes of rotation $P_1$, $P_2$. Each of the axes $P_1$, $P_2$ are vertically offset from one another. The spacer member $20_1$ is rotatable about its axis $P_1$ by way of a rotatable support formed by way of nut/bolt arrangement 74 operable through elongate slot $52_A$ formed in the vertically aligned side plate 52, and a corresponding elongate slot $54_A$ formed in the central plate 54. The elongate direction of both elongate slots $52_A$, $54_A$ is aligned in the vertical plane, which allows the axis $P_1$ freedom to move or translate in the vertical plane. This rotatable supporting (and vertical translation) configuration is provided for all spacer members 20 and allows the drill rod storage assembly 5 to be tilted (for example, by way of a base or platform upon which it sits) according to drill rod loading/unloading requirements. Such movement or translation of the axes of rotation $P_1$ of the respective spacer member $20_1$ is substantially linear, but could also be, in another embodiment, non-linear.

Similarly, the spacer member $20_2$ is rotatable about its axis $P_2$ by way of a rotatable support formed by nut/bolt arrangement 76 operable through elongate slot $50_A$ formed in the vertically aligned side plate 50, and a corresponding elongate slot $54_A$ (spaced from the lowermost elongate slot $54_A$ associated with the spacer member $20_1$) formed in the central plate 54. As with the axis $P_1$, the elongate direction of the elongate slot $50_A$ is aligned in the vertical plane allowing the axis $P_2$ freedom to move or translate in the vertical plane.

Figure 14:
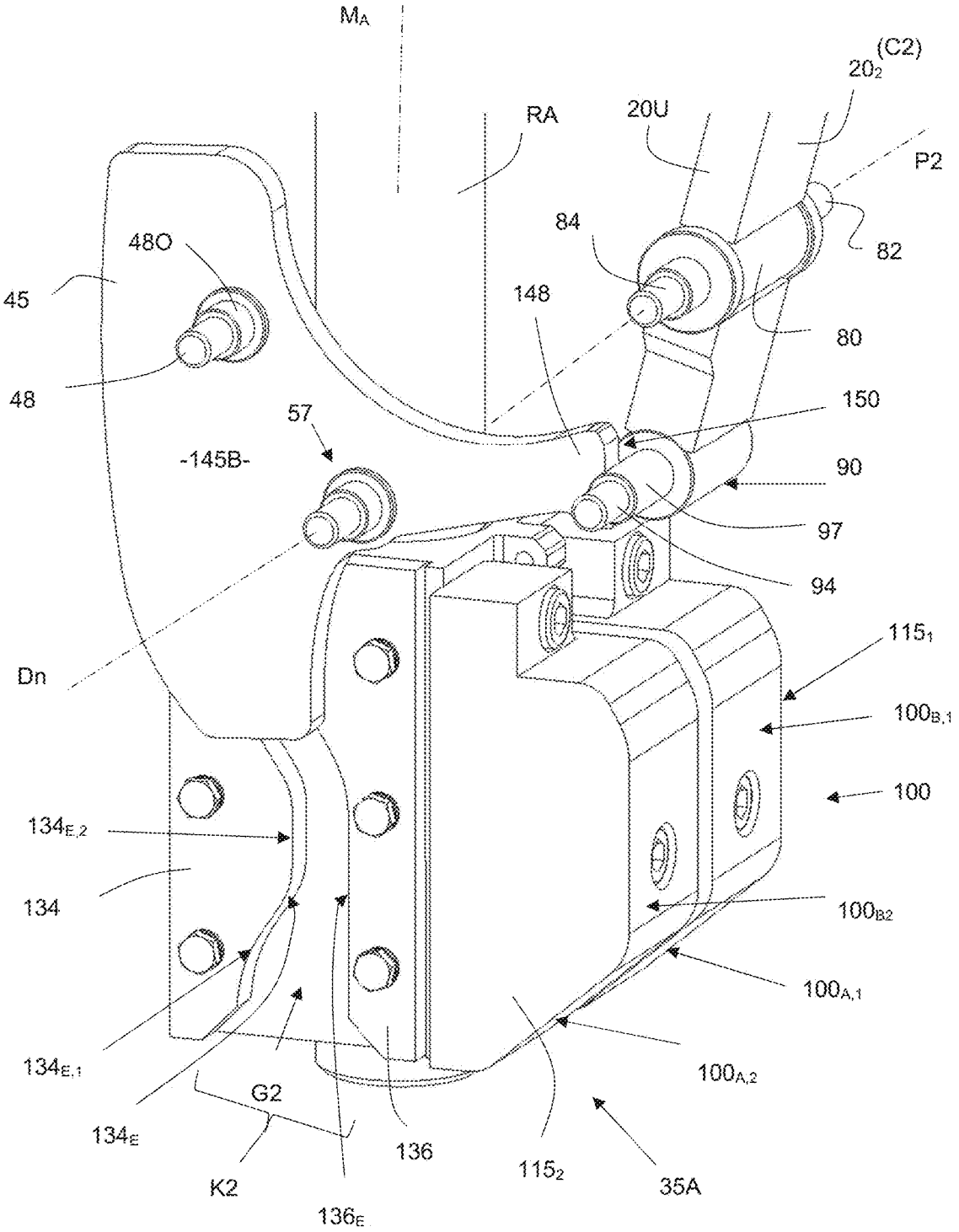
FIG. 14 shows a further perspective view of that shown in FIG. 13.

As more clearly seen in FIG. 13 and FIG. 14, the spacer member $20_2$ comprises a shaft pivot 80 which extends across the width dimension of the spacer member. The shaft pivot 80 comprises shaft portions 82 and 84 which extend outward from respective sides of the spacer member $20_2$ and aligned concentric with the axis $P_2$. Each of the shaft portions 82, 84 comprise a threaded region carried by their respective external surfaces, which threaded regions threadedly engage with a respective nut $N_R$ (as shown) for use in restricting axial movement of the shaft portion 80 (and spacer member $20_2$) along the axis $P_2$. Washers 85 are also used (as shown in FIG. 9) to provide a bearing surface between respective sides of the shaft pivot 80 where they interface with the inward facing surfaces of the side plate 52 and the central plate 54.

Substantially the same rotatable support (and vertical translation) arrangement as described above is used for the rotatable support of the spacer member $20_1$, and, indeed, all spacer members 20 carried by respective drill rod spacer movers $15_A$, $15_B$.

With reference again to FIG. 9, freedom of each spacer member $20_1$, $20_2$ to rotate or pivot about its respective axis of rotation $P_1$, $P_2$ is also enabled by an interaction of a portion of respective ends 90 (better seen in FIG. 13) of each spacer member with a slot 92 formed in the relevant of the vertically aligned side plates 50, 52. The end 90 of each spacer member $20_1$, $20_2$ comprises a pin member 94 which extends outward from the end 90 and into a respective guiding slot 92, the shape/length of which influences the scope/extent of rotational movement of the relevant spacer member $20_1$, $20_2$ about its axis. Each pin member 94 is in fixed relation with end 90 of its respective spacer member $20_1$, $20_2$, and carries a threaded region on its exterior which engages with a nut $N_G$ for assisting in stabilizing movement (to the extent that might be required) of respective spacer members $20_1$, $20_2$ (in cooperation with the rotatable support arrangement involving the shaft pivot 80 and associated components) from lateral loading when rotating about its respective axis. Washers 85 are also used with nuts $N_G$, $N_R$.

As seen in FIG. 9, outward extension of the pin member 94 from the end 90 of the spacer member $20_2$ (of the column $C_2$) is toward the left of page, as there is no corresponding guiding slot formed in the central plate 54 that corresponds with the guiding slot 92. Similarly, the outward extension of the pin member 94 from the end 90 of the spacer member $20_1$ (of the column $C_1$) is toward the right of page and engages with guiding slot 92 formed in the vertically aligned plate 52 (visible in FIG. 8).

As seen in FIG. 9, each guiding slot 92 is shaped in an arc like form so as to facilitate movement/guidance of the spacer members $20_2$ about its respective axis of rotation $P_2$ in rotating/pivoting between respective first $20_U$ and second positions $20_D$, as influenced by the direction movement of the body 35.

It will be appreciated that rotatable support for each spacer member 20 by the relevant of the vertically aligned side plates 50, 52 and central plate 54, and which provides for the shaft pivot 80 to move/translate in the vertical plane (ie. via elongated slots $50_A$, $52_A$, $54_A$), can be achieved in various ways known to the skilled reader that will not depart of the principles described herein. Furthermore, guidance of the end 90 of each spacer member 20 through an arc of desired scope/extent could also be achieved in various ways known to the skilled reader that will not depart from the principles described herein.

Figure 4:
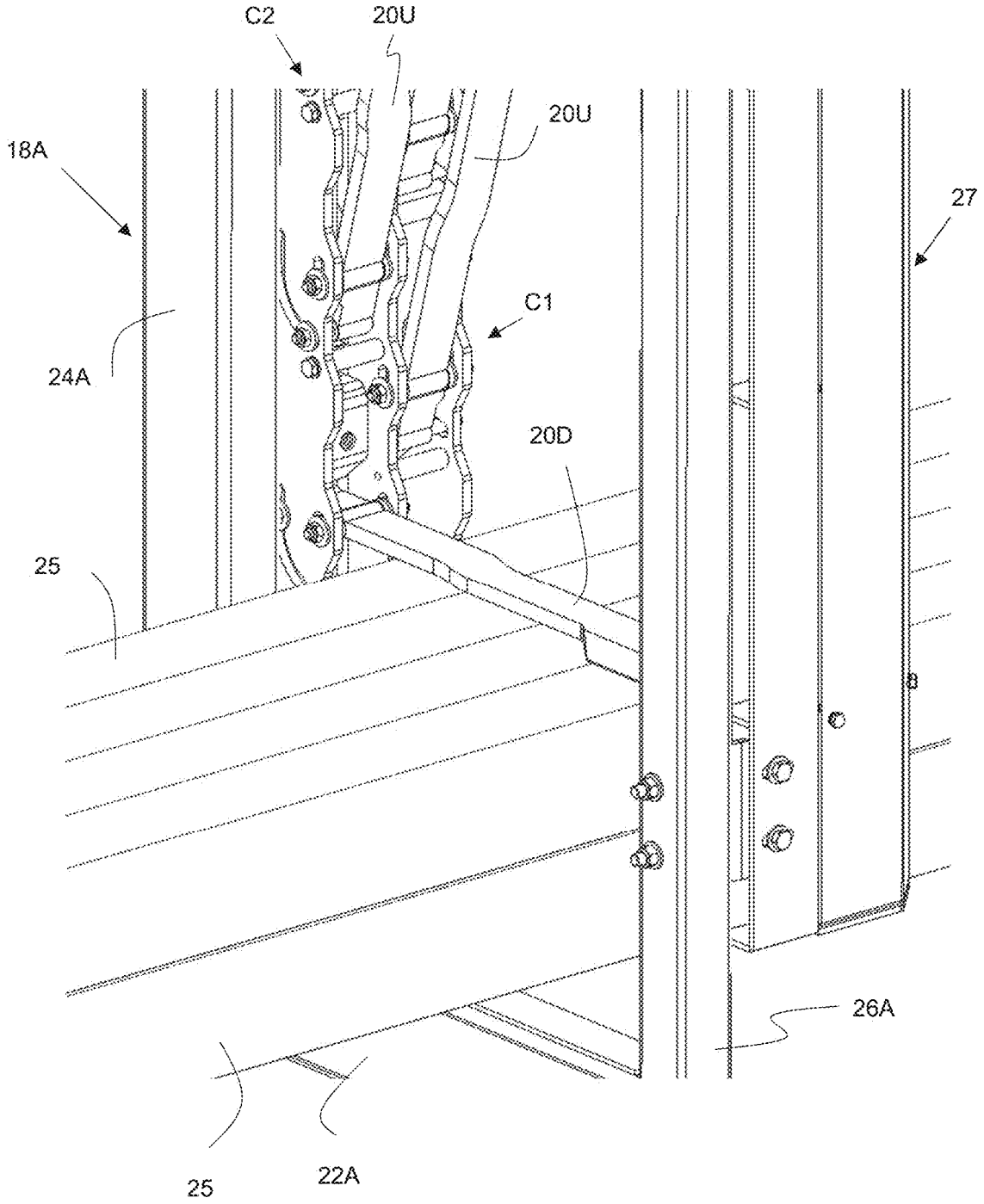
FIG. 4 shows a perspective view of the region identified as B in FIG. 2.

With reference to FIGS. 3, 4, and 5, each spacer member 20 is of elongate form of finite length, thickness and width (transverse to its length). A portion 96 of the elongate form of each spacer member 20 is configured so as to support the drill rods 25 when the spacer member is in its second position $20_D$. End 90 of each spacer member 20 is configured so as to interact with the body $35_A$ (hereinafter, body 35, but shown in the Figures as $35_A$) in the movement of the spacer members 20 between their respective first $20_U$ and second $20_D$ positions.

Each spacer member 20 comprises paddle portions 98 which extend outward substantially transverse relative to its general elongate form, and which extend along a substantial portion of the length of the portion 96 upon which the drill rods 25 land. The paddle portions 98 serve to increase the 'landing' surface upon which the drill rods 25 supported, and operate with chamfered corner portions (shown in FIG. 3) for reducing the likelihood of the drill rods 25 catching on edges when being loaded and unloaded (for example, when a drill rod 25 is sliding in/out of a 'cup' of a drill rod handler apparatus akin to that described in WO2019/028518).

With reference to FIGS. 3 and 5, distal ends 91 (shown in FIG. 5) of the spacer members 20 are configured so as to be received and/or supported by support brackets 27 that are mounted to various of the upright assemblies 26 (those opposite to the drill rod spacer movers $15_A$, $15_B$) for assisting in reducing the amount or degree of prospective lateral force (in the direction of the axis X) that might be experienced and imparted to the relevant drill rod spacer mover $15_A$, $15_B$ (which could cause damage thereto). As seen in FIG. 3, distal ends 91 of the spacer members 20 are configured so as to project within vertically aligned and adjacently disposed extending channels $93_1$, $93_2$ that are formed by way of the construction of the relevant support bracket 27. For example, channel $93_1$ is arranged so as to operate with the distal ends 91 of the spacer members 20 of column $C_1$, and channel $93_2$ is arranged so as to operate with the distal ends 91 of the spacer members 20 of column $C_2$.

Broadly, interaction between the body 35 and the spacer members 20 serves to move the spacer members to their respective first positions $20_U$ when the body 35 moves downwards, as shown in FIGS. 15 to 19. When the body 35 is driven upwards, interaction between the body 35 and the spacer members 20 serves to facilitate movement of the spacer members to their respective second positions $20_D$.

Figure 12:
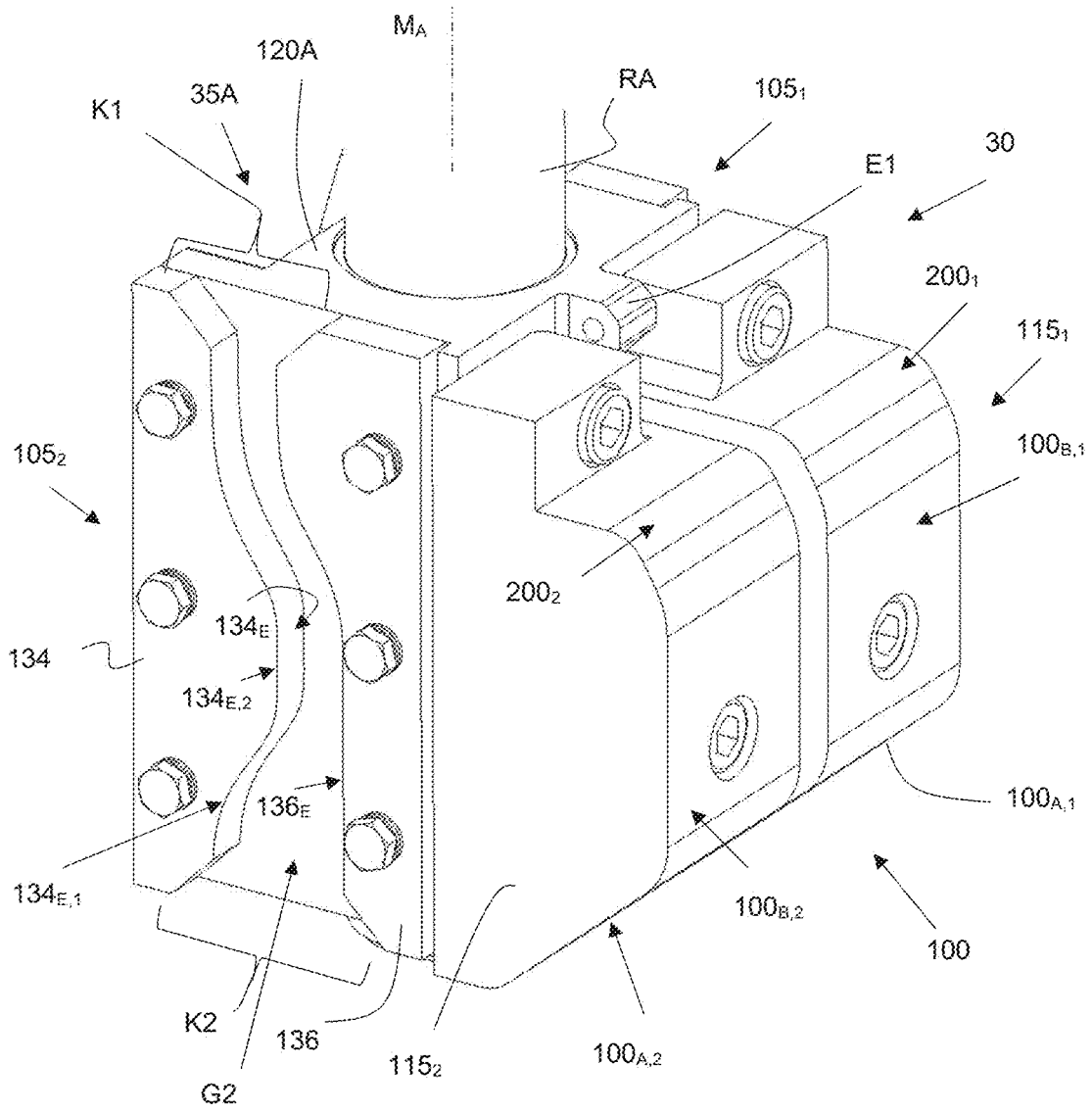
FIG. 12 shows a perspective view of the embodiment of the body of the drill rod spacer mover shown in the preceding Figures.

With reference to FIG. 12, the body 35 comprises a first side 100 configured for interacting with the end 90 of the respective spacer member 20 as the body passes thereby. Such interaction, depending on the direction of movement of the body 35 (ie. up or down the rail R), facilitates rotation of the relevant spacer member 20 about its axis of rotation $P_n$ toward either its respective first position $20_U$ or its respective second position $20_D$.

Broadly, the first side 100 of the body 35 is configured having surface portion $100_A$ which interacts affirmatively with the end 90 of each spacer member 20 for moving same toward its first position 20*u*. The surface portion $100_A$ of the first side 100 is substantially planar (but could be non-planar) and arranged in angled relation to a generally vertically aligned surface portion $100_B$, as shown in FIG. 12. As shown, the form/configuration of the surface portions $100_A$, $100_B$ confer a wedge-like form to the body 35.

For the embodiment shown, the body 35 is formed so that its first side 100 is able to interact with ends 90 of the spacer members 20 of both columns $C_1$ and $C_2$ in moving the spacer members 20 about their respective axes of rotation. The body 35 is formed so as to provide a pair of wedge-like bodies arranged in side-by side relation with the carriage $120_A$: a first wedge-like body 1151 operable with the spacer members 20 of column $C_1$, and a second wedge-like body 1152 operable with the spacer members 20 of column $C_2$ (collectively, wedge-like bodies 115).

Each of the wedge-like bodies 115 comprise a flat first side which abuts and fastens (using hex bolts) to a side of the carriage $120_A$ (as shown in FIG. 12), and a shaped second side projecting outward of the carriage $120_A$, and which provides two faces which form the first side 100 of the body 35 and which interact with respective ends 90 of each spacer member 20: a first portion $100_A$ providing an angled planar surface (hereinafter, angled planar surface $100_A$), and a second portion $100_B$providing a generally vertically aligned planar surface (hereinafter, vertically aligned planar surface $100_B$). In FIG. 12, the additional subscripts 1,2 of the angled planar surface $100_A$ and the vertically aligned planar surface $100_B$ denote their respective host wedge-like body. As seen in FIG. 12, the first side 100 of the body 35 tapers inward toward the axis $M_A$ from the vertically aligned planar surface $100_B$ to the angled planar surface $100_A$.

As also shown in FIG. 12, each of the wedge-like bodies 115 further comprise respective shaped edgings $200_1$, $200_2$ (collectively, shaped edgings 200) where the respective vertically aligned planar surfaces $100_B$ terminate.

The body 35 comprises a second side 105 configured for interacting with the detent member 45 for moving the detent member into a position for providing support to an associated spacer member 20 once in its first position $20_U$.

Broadly, the second side 105 of the body 35 comprises a groove G which is shaped so as to provide a generally non-linear path. In this manner, the groove G is configured so as to operate as a guiding channel or slot when interacting with the detent member 45 for guiding movement of the detent member (by way of one or more edges defining the groove G) into a position for conferring support to an associated spacer member 20 once in its first position $\mathbf{20}_U$. Thus, the configuration of the second side 105 of the body 35 is arranged so as to cause an interaction with the detent member 45 as the relevant body passes thereby which causes the detent member 45 to rotate about its associated axis of rotation $D_n$ toward a support conferring position in which the detent member 45 is capable of contacting and supporting its associated spacer member 20 in its first position $\mathbf{20}_U$. Movement of the detent member 45 toward or away from its position in supporting its associated spacer member 20 depends on the direction of movement of the body 35.

Like with the provision of the first side 100, the body 35 is formed so that its second side 105 interacts with detent members 45 of both columns $C_1$, $C_2$. The body 35 is therefore formed so as to provide a second side $\mathbf{105}_1$ (adjacent wedge-like body $\mathbf{115}_1$) that is operable with each of the detent members 45 of column $C_1$, and a second side $\mathbf{105}_2$ (adjacent wedge-like body $\mathbf{115}_2$) that is operable with each of the detent members 45 of column $C_2$. Both 'second' sides $\mathbf{105}_1$, $\mathbf{105}_2$, comprise respective grooves $G_1$, $G_2$ each formed by way of the cooperation of adjacently disposed elements that are each shaped on respective facing edges to provide the shaped path of the relevant groove $G_1$, $G_2$. For the case of the 'second' side $\mathbf{105}_1$, groove $G_1$ is formed by way of facing edges $\mathbf{130}_E$, $\mathbf{132}_E$ of respective elements 130, 132 (as shown in FIG. 13); and, for the case of the 'second' side $\mathbf{105}_2$, groove $G_2$ is formed by way of facing edges $\mathbf{134}_E$, $\mathbf{136}_E$ of respective elements 134, 136 (as shown in FIG. 12). Each of the elements 130, 132, 134, 136 are fastened to respective opposite sides of the carriage $\mathbf{120}_A$ using bolts as shown in FIGS. 12 and 13.

In the embodiment shown in FIGS. 1B to 19, the first 100 and second 105 sides of the body 35 are formed separately and fastened to the carriage $\mathbf{120}_A$ by way of a suitable fastening assembly, for example using bolts (as clearly shown in FIGS. 12 and 13). However, it will be appreciated that the first 100 and/or second 105 sides of the body 35 could be formed so as to be integral with the carriage $\mathbf{120}_A$ in forming the body.

With reference to FIG. 14 (showing a portion of the functional arrangement of the column $C_2$), each detent member 45 comprises a body $\mathbf{145}_B$ having a support conferring portion 148 which extends outward from the body $\mathbf{145}_B$, and is configured at a distal extent 150 for engaging with a contact portion 97 of the pin member 94 of the end 90 of its associated spacer member 20.

With reference to FIGS. 11 and 14, each detent member 45 comprises a pin member 48 having an end $\mathbf{48}_I$ which extends inwards (toward the axis $M_A$ along which the body 35 moves) of its body $\mathbf{145}_B$ so as to interact with the relevant groove $G_1$, $G_2$. The end $\mathbf{48}_I$ of the pin member 48 of each detent member 45 is dimensioned so as to be received within the relevant groove $G_1$, $G_2$. Each pin member 48 further comprises a portion $\mathbf{48}_O$ which interacts with a slot 155 formed in the relevant of the vertically aligned side plates 50, 52 (whichever rotatably supports the subject detent member 45). A distal end of the pin member 48 adjacent to the portion $\mathbf{48}_O$ threadedly engages with a nut $N_P$ (FIG. 11).

The slot 155 is arc shaped of finite length with opposite ends $\mathbf{155}_1$, $\mathbf{155}_2$ (shown in FIG. 18) which prescribes an amount of freedom of rotational movement of the detent member 45 about its axis $D_n$ when caused to be moved by way of the interaction of the end $\mathbf{48}_I$ of the pin member 48 with the edges of the relevant groove $G_1$, $G_2$. When the detent member 45 is in the position shown in FIG. 14 and engaged with the contact portion 97 of the spacer member 20, movement of the pin member 94 through the slot 92 is restricted or blocked resulting in the spacer member 20 being held in its first position $\mathbf{20}_U$ bearing against the detent member 45, which is itself 'locked' in position by way of the portion $\mathbf{48}_O$ of the pin member 48 bearing against the end $\mathbf{155}_1$ of a slot 155 (see the upper most detent member 45 shown in FIG. 15, in which the portion $\mathbf{48}_O$ of the pin member 48 bears against the end $\mathbf{155}_1$ of the slot 155).

Rotation or pivoting movement of the detent member 45 is therefore by way of the end $\mathbf{48}_I$ of the pin member 48 engaging with the edges that form the relevant groove $G_1$, $G_2$. The scope of rotational movement of the detent member 45 is governed by the interaction between the portion $\mathbf{48}_O$ of the pin member 48 with the ends $\mathbf{155}_1$, $\mathbf{155}_2$ of the slot 155. The shape/configuration of the relevant groove $G_1$, $G_2$ and the slot 155 therefore operate in a cooperable manner for causing the detent member 45, by way of the interaction between the end $\mathbf{48}_I$ of the pin member 48 and the edges of the relevant groove $G_1$, $G_2$ when moving via the body 35, to rotate a desired extent (between ends $\mathbf{155}_1$, $\mathbf{155}_2$—shown in FIG. 18—of the slot 155) about the axis $D_n$ so as to either move to a position for supporting its associated spacer member 20, or away from such a position (depending, of course, on the direction of movement of the body 35). As will be understood by the skilled reader, the extent of rotational movement of the detent member 45 is not required to be overly large, but only of sufficient scope to allow its distal extent 150 to avoid interfering with the movement of the pin member 94 of (the end 90) of its associated spacer member 20 as it is rotated through the slot 92 by the body $\mathbf{35}_A$ toward its first position $\mathbf{20}_U$.

As seen in FIGS. 13 and 14, a feature of the grooves $G_1$, $G_2$ is a spatial disparity of the edges of one side of the grooves, such disparity causing to bias movement of the end $\mathbf{48}_I$ when interacting with the relevant groove as the body 35 moves. As seen in FIG. 13, edge $\mathbf{130}_E$ of the groove $G_1$ comprises edge portions $\mathbf{130}_{E,1}$ and $\mathbf{130}_{E,2}$, and as seen in FIG. 14, edge $\mathbf{134}_E$ of the groove $G_2$ comprises edge portions $\mathbf{134}_{E,1}$ and $\mathbf{134}_{E,2}$. In each case, the transition between edge portions $\mathbf{130}_{E,1/2}$, $\mathbf{134}_{E,1/2}$ represents a spatial disparity which, as will be shown in FIGS. 15 to 19, biases movement of the detent member 45 about its axis of rotation Dn.

Respective opposite open ends $K_1$, $K_2$ of each groove $G_1$, $G_2$ are both open and operate as entry and exit regions for the end $\mathbf{48}_I$ depending on the relative movement between the body 35 and the detent member 45. For example, open end $K_2$ operates as an entry for end $\mathbf{48}_I$, and open end $K_1$ as an exit for the end $\mathbf{48}_I$ when the body 35 moves downward to move the spacer members 20 into their respective first positions $\mathbf{20}_U$. For the case when the body 35 moves upwards (releasing the detent members 45 from supporting their associated spacer members 20), open end $K_1$ operates as an entry for the end $\mathbf{48}_I$, and open end $K_2$ as an exit for the end $\mathbf{48}_I$.

As seen in FIGS. 13 and 14, the width of the open end $K_2$ is greater than for open end $K_1$. This is to account for the scenario when the body 35 is moving downward (ie. moving the spacer members 20 to their first positions $\mathbf{20}_U$) where the detent member 45 is not subject to any load from its associated spacer member 20, and the portion $\mathbf{48}_O$ of the pin member 48 is therefore not biased against the end $\mathbf{155}_1$ of the slot 155. As such, the end $\mathbf{48}_I$ is not guaranteed to be readily aligned with the edges 130, 134 of the respective grooves $G_1$, $G_2$—as is the case for the reverse movement when the body 35 is moving upwards to release the spacer members 20 from their associated detent member 45. Thus, with no load biasing the portion $\mathbf{48}_O$ of the pin member 48 against the end $\mathbf{155}_1$ of the slot 155, movement of the drill rod storage receptacle 5 (of the base/platform on which it is supported, for example) could inadvertently shift the detent member 45 to an alternate position, thereby displacing the end $\mathbf{48}_I$ to any position allowed by the scope of the slot 155. Accordingly, the increased width of the open end $K_2$ serves to widen the entry into the relevant groove $G_1$, $G_2$ in the event that the end $\mathbf{48}_I$ becomes displaced.

Chamfers either side of the open ends $K_1$, $K_2$ assist in guiding entry of the end $\mathbf{48}_I$ of the pin member 48 into the groove $G_1$, $G_2$.

The relevant interactions between the body 35, the relevant spacer members 20, and the respective associated detent members 20 occur at about the same time as the body 35 completes its passing of the relevant spacer member 20.

For the most part, each spacer member 20 is arranged in operable association with a respective detent member 45 for the purpose of the detent member 45 supporting the relevant spacer member 20 ($\mathbf{20}_1$ in FIG. 9) in its first position $\mathbf{20}_U$. However, as can be seen from FIG. 9, the lower most spacer member $\mathbf{20}_1$ of each drill rod spacer mover $\mathbf{15}_A$, $\mathbf{15}_B$ does not require support from a detent member 45 to be supported in its first position $\mathbf{20}_U$. Instead, on moving of the respective body $\mathbf{35}_A$, $\mathbf{35}_B$ to the lower most position (proximal the lower end assembly 58, as shown in FIG. 9), the lower most spacer member $\mathbf{20}_1$ is supported in position by way of its contact with the relevant body $\mathbf{35}_A$, $\mathbf{35}_B$. In this manner, the respective body $\mathbf{35}_A$, $\mathbf{35}_B$ serves, in effect, as a detent member for the lower most spacer member $\mathbf{20}_1$ of each drill rod spacer mover $\mathbf{15}_A$, $\mathbf{15}_B$ for supporting the spacer member $\mathbf{20}_1$ in its first position $\mathbf{20}_U$.

Operation of the drill rod spacer mover $\mathbf{15}_A$ is shown in FIGS. 15 to 19 in which a sequence of downward movement of the body $\mathbf{35}_A$ of the spacer mover $\mathbf{15}_A$ is shown. Of course, the drill rod spacer mover $\mathbf{15}_B$ operates in the substantially the same manner. In the embodiment of the drill rod spacer mover assembly 15 shown, the bodies $\mathbf{35}_A$, $\mathbf{35}_B$ of respective drill rod spacer movers $\mathbf{15}_A$, $\mathbf{15}_B$ are synchronized so as to move along their respective axes $M_A$, $M_B$ in the same manner. However, the drill rod spacer mover assembly 15 could be arranged so that the bodies $\mathbf{35}_A$, $\mathbf{35}_B$ of respective drill rod spacer movers $\mathbf{15}_A$, $\mathbf{15}_B$ are not synchronized (as might be required for a specific application).

Figure 15:
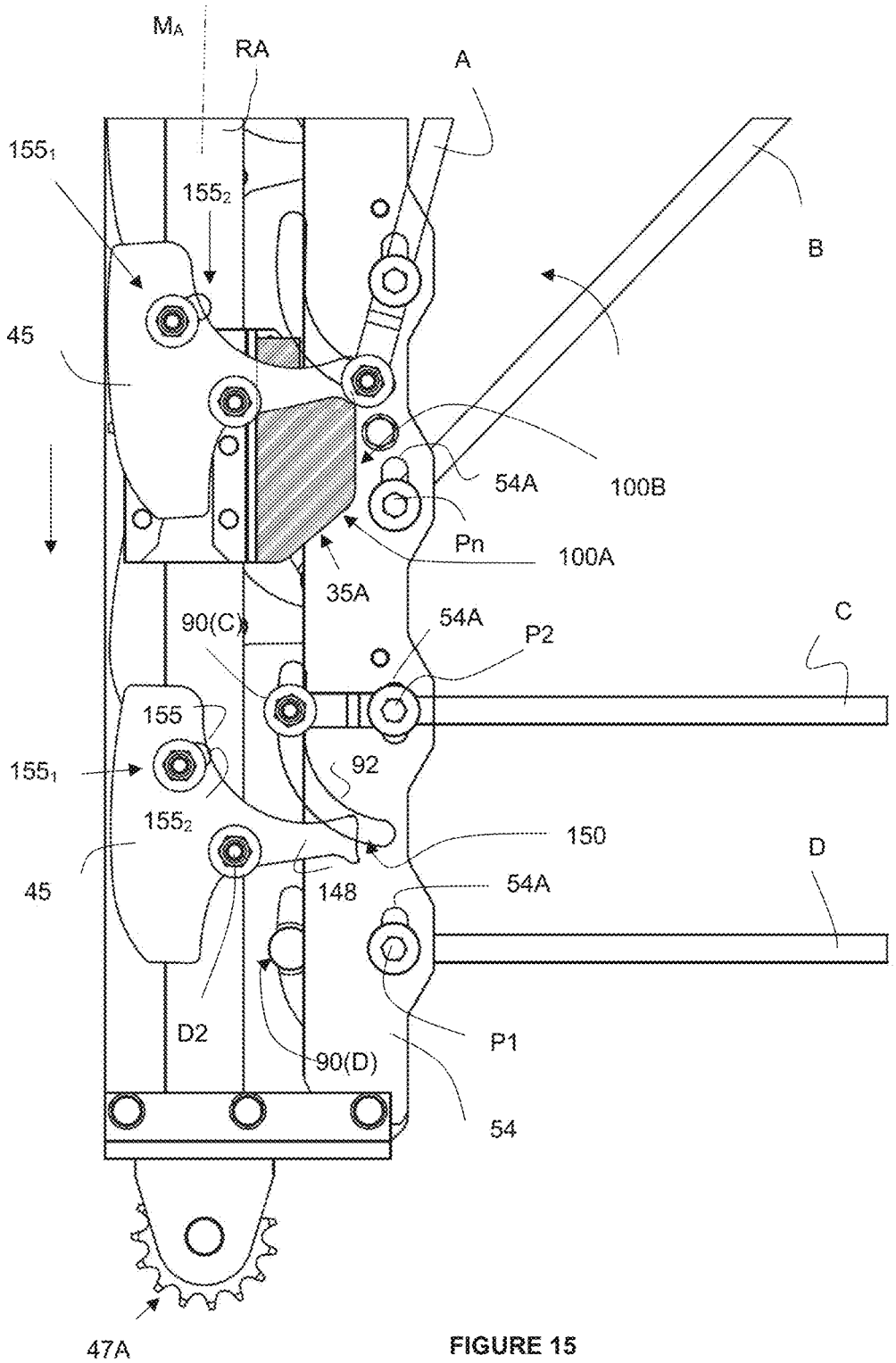
FIG. 15 shows a side view of the embodiment of the drill rod spacer mover shown in the preceding Figures, with the body moving downwards for interacting with a plurality of spacer members.

FIG. 15 shows the start of a sequence in which the body 35 is already moving downward along the rail $R_A$ along the axis $M_A$, having already moved a spacer member A (of the column $C_2$) to its first position 20*u*. The spacer member C (of column $C_2$) and D (of column $C_1$) reside in their second respective positions $\mathbf{20}_D$.

In the position shown in FIG. 15, the first side 100 (specifically, the angled planar surface $\mathbf{100}_A$) of the body $\mathbf{35}_A$ has engaged with the rounded form of the end 90 of the spacer member B (of column $C_1$) causing it to rotate about its axis of rotation $P_2$ in the direction indicated. The end 90 of the spacer rides along the angled planar surface $\mathbf{100}_A$ due to the self-weight of the spacer member C causing clockwise rotation about the axis $P_2$ as the body $\mathbf{35}_A$ continues to move downward, until which time the end 90 reaches the extent of the angled planar surface $\mathbf{100}_A$ and transitions to contact with the vertically aligned planar surface $\mathbf{100}_B$.

Figure 16:
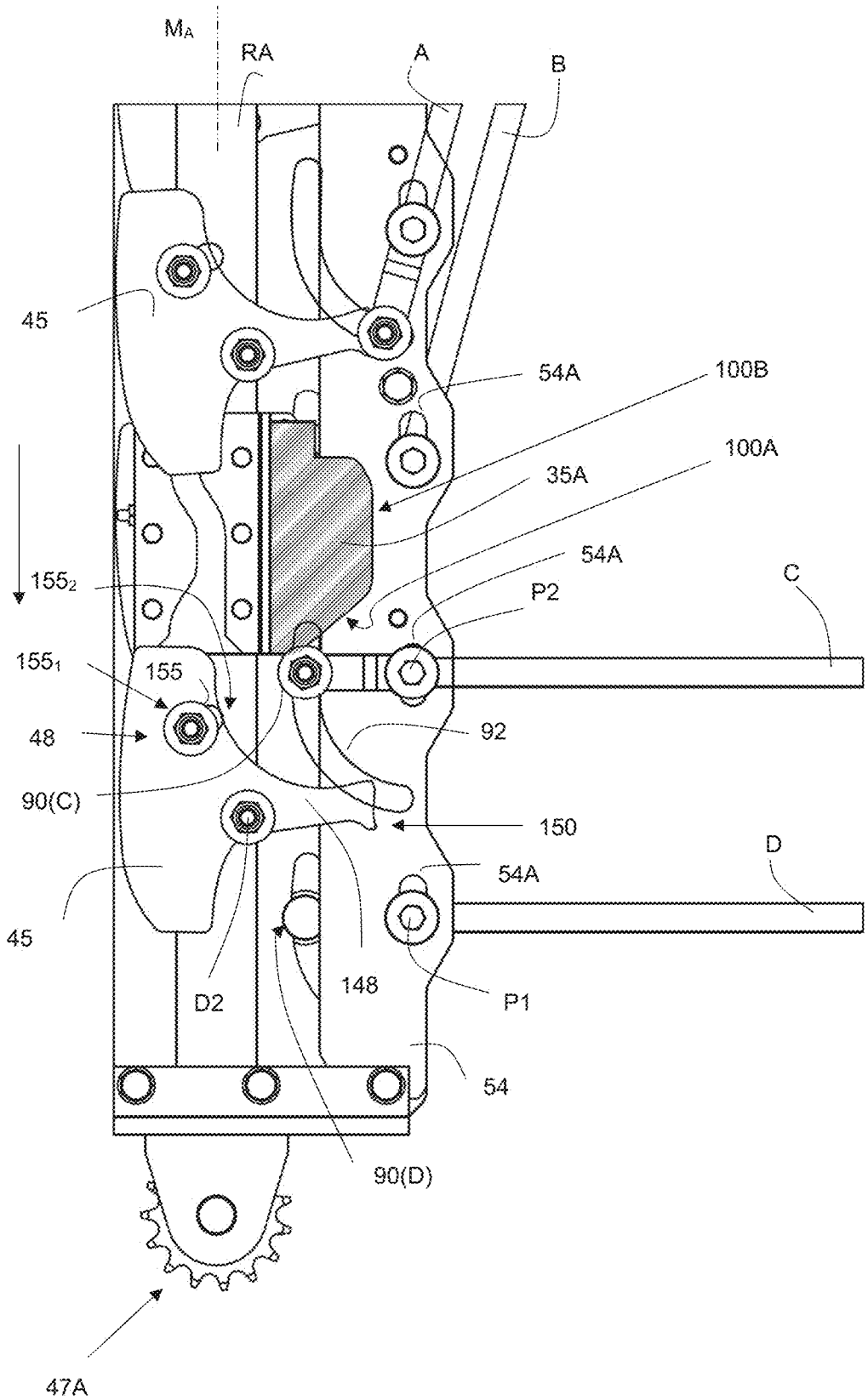
FIG. 16 shows an advancement of the movement of the body from that shown in FIG. 15.

FIG. 16 shows an advancement of the body $\mathbf{35}_A$ from that shown in FIG. 15. Once the full extent of the angled planar surface $\mathbf{100}_A$ has been passed by the end 90, no further rotation will occur, and the end 90 will run along the vertically aligned planar surface $\mathbf{100}_B$ (contact being due to the clockwise bias of the spacer member B about its axis of rotation $P_n$ due to its self-weight). At about this time, interaction between the second side 105 of the body $\mathbf{35}_A$ (that relating to column $C_1$) has completed and the relevant detent member 45 moved to a position so that its distal extent 150 is in supportive contact with the contact portion 97 of the pin member 94 of the end 90 thereby supporting the spacer member B in its first position $\mathbf{20}_U$ (while this movement has been obscured from view in FIGS. 15 and 16, an analogous movement will be shown in FIGS. 17 to 19 in the movement of the spacer member C (of column $C_2$)) to its first position $\mathbf{20}_U$.

FIG. 16 further shows the angled planar surface $\mathbf{100}_A$ of the first side 100 of the body $\mathbf{35}_A$ about to engage the rounded form of the end 90 of the spacer member C. As shown, the end 90 of the spacer member C resides near an end of the slot 92 formed in the vertically aligned side plate 50 (this being its usual position when the spacer member 20 is in its second position $\mathbf{20}_D$).

The end $\mathbf{48}_I$ of the pin member 48 of the detent member 45 is shortly to interact with the shaped groove $G_2$.

Figure 17:
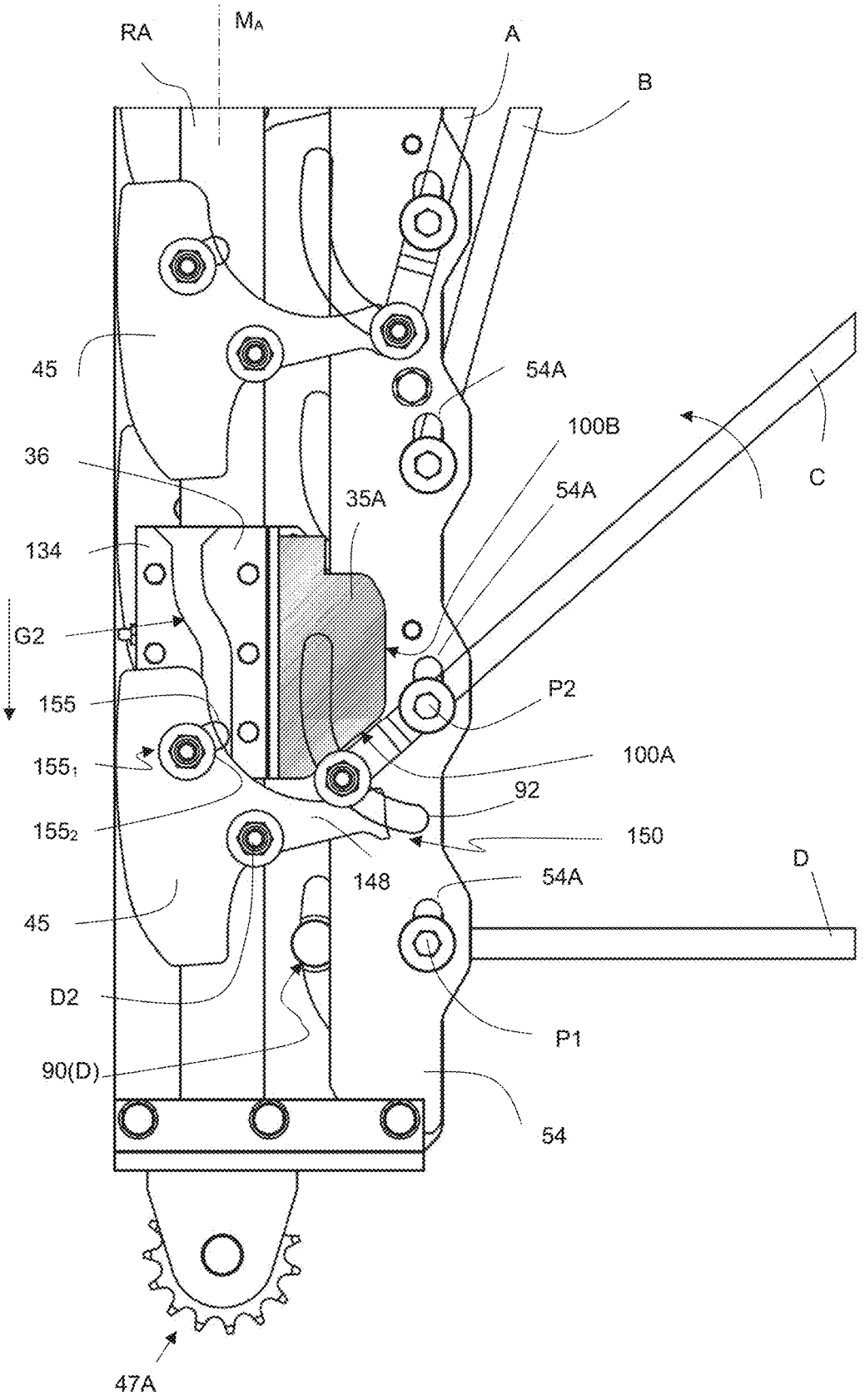
FIG. 17 shows an advancement of the movement of the body from that shown in FIG. 16.

FIG. 17 shows contact having been made between the angled planar surface $\mathbf{100}_A$ and the rounded form of the end 90 of the spacer member C. Continued movement of the body $\mathbf{35}_A$ downwards along axis $M_A$ causes the end 90 to ride along the angled planar surface $\mathbf{100}_A$ toward its outward most extent. As is clearly seen, interaction between the angled planar surface $\mathbf{100}_A$ and the end 90 causes the spacer member C to rotate in the direction shown (counter-clockwise) about axis $P_2$. Furthermore, the end 90 can be seen having moved along the length of the slot 92 from its position shown in FIG. 16.

The end $\mathbf{48}_I$ of the pin member 48 has now been received in the shaped groove $G_2$ and shortly to be subject to interaction with edge portions $\mathbf{134}_{E,1}$ and $\mathbf{134}_{E,2}$ as the body 35 continues to move downward.

Figure 18:
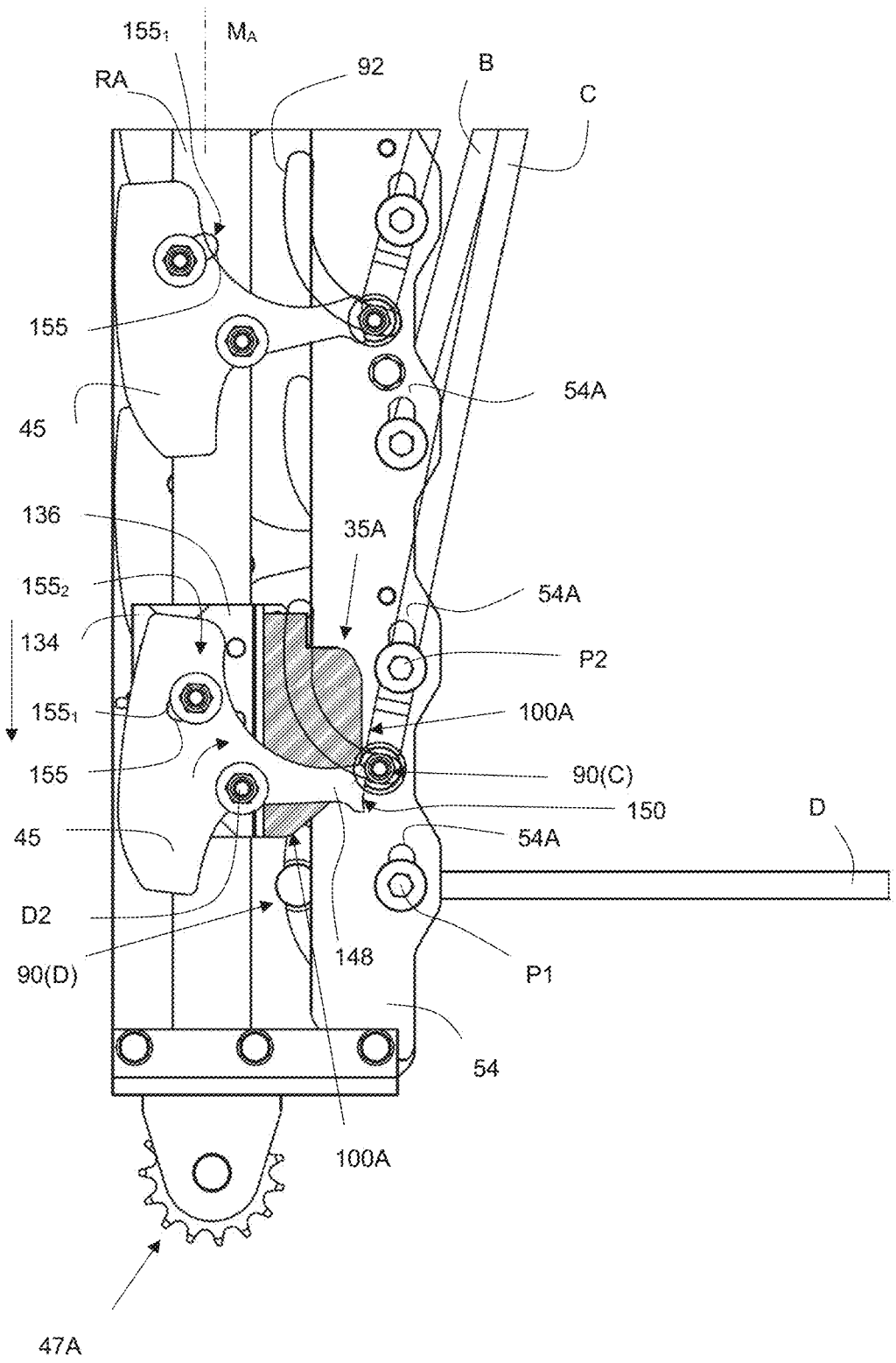
FIG. 18 shows an advancement of the movement of the body from that shown in FIG. 17.

FIG. 18 shows an advancement of the body $\mathbf{35}_A$ from that shown in FIG. 17 whereby the end 90 has reached the outward most extent of the angled planar surface $\mathbf{100}_A$ and is almost at the end of the slot 92 following counter-clockwise rotation of about the axis $P_2$. As such, further rotation of the spacer member C about the axis $P_2$ due to interaction with the side 100 of the body $\mathbf{35}_A$ will not occur. The self-weight of the spacer member C causes its end 90 to bear against the vertically aligned planar surface $\mathbf{100}_B$. Any additional (and minor) rotation of the spacer member C will be due to movement of the detent member 45 as it is operated to complete its movement to support the space member C in its first position $\mathbf{20}_U$.

At about this time, interaction between the edge portion $\mathbf{134}_{E,2}$ of the groove $G_2$ and the end $\mathbf{48}_I$ of the pin member 48 has caused rotation (constrained due to the scope of movement provided to the portion $\mathbf{48}_O$ of the pin member 48 moving within the slot 155) of the detent member 45 about the axis $D_2$ in the direction indicated in FIG. 18 (clockwise). As noted above, the extent of rotation movement of the detent member 45 is not required to be large, but only sufficient scope of movement is needed to allow its distal extent 150 to avoid interfering with the movement of the pin member 94 of (the end 90) of the spacer member C as it is rotated through the slot 92 by the body $\mathbf{35}_A$. This rotation allows sufficient space for the distal extent 150 of the detent member 45 to position for bearing against the contact portion 97 of the end 90 of the spacer member C just as it reaches maximum travel within the slot 92. The shaped form of the distal extent 150 is configured so that the contact portion 97 can move thereagainst and locate therewith appropriately so as to held in position as the detent member 45, via the end $\mathbf{48}_I$ of the pin member 48, is relieved of any bias provided by the edges of the groove $G_2$. Once the spacer member C is engaged with the detent member 45, and the end $\mathbf{48}_I$ now free from any bias from its interaction with the edges of the groove $G_2$, the detent member becomes subject to a counter-clockwise rotation about its axis $D_2$ due to the end 90 of the spacer member C now bearing against the detent member 45 (via the distal extent 150) caused by the self-weight of the spacer member C provoking clockwise rotation about the axis $P_2$. Counter clockwise rotation of the detent member 45 is constrained by the portion $\mathbf{48}_O$ of the pin member 48 abutting against the end $\mathbf{155}_1$ of the slot 155, thereby enabling the detent member to support the spacer member C in its first position $\mathbf{20}_U$.

Figure 19:
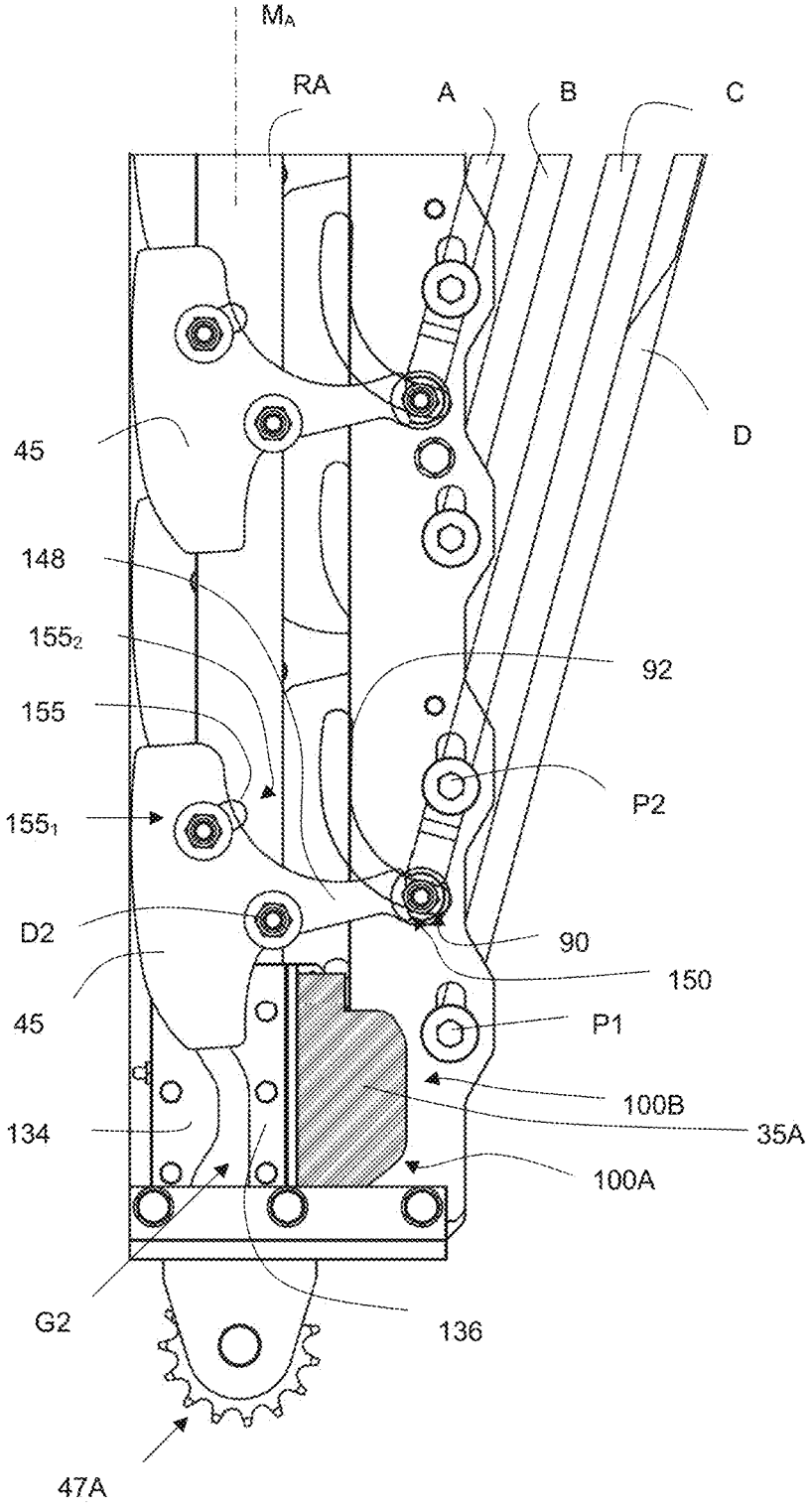
FIG. 19 shows an advancement of the movement of the body from that shown in FIG. 18.

FIG. 19 shows an advancement of the body $\mathbf{35}_A$ from that shown in FIG. 18 whereby the movement of the body $\mathbf{35}_A$ from the position shown in FIG. 15 has completed with all spacer members A, B, C, and D having been moved to their respective first positions $\mathbf{20}_U$.

As will be appreciated from FIG. 19, the lower most spacer member D does not need to be operable with a respective detent member 45 as its end 90 remains in contact with the vertically aligned planar surface $\mathbf{100}_B$ when the body $\mathbf{35}_A$ has completed its movement and comes to rest at the lower end of the drill rod spacer mover $\mathbf{15}_A$. Thus, in this instance, the body $\mathbf{35}_A$, via its vertically aligned planar surface $\mathbf{100}_B$, serves as a detent member for supporting the spacer member D in its first position $\mathbf{20}_U$.

Movement of the spacer members A, B, C, and D from their respective first positions $\mathbf{20}_U$ is undertaken in a sequential manner, commencing with the spacer member D, by the body $\mathbf{35}_A$ being driven upwards along the axis $M_A$. Substantially the same interactions are carried out but in the reverse manner.

On upward movement of the body $\mathbf{35}_A$, the shaped edging 200 of the first side 100 of the body $\mathbf{35}_A$ engages with the rounded form of the end 90 of the spacer member C, the engagement biasing the spacer member C so as to rotate slightly counter-clockwise until bearing against the vertically aligned surface $\mathbf{100}_B$ SO that it may run therealong as upward movement of the body $\mathbf{35}_A$ continues.

At about the same time, the end $\mathbf{48}_I$ of the pin member 48 enters the groove $G_2$. Continued upward movement of the body $\mathbf{35}_A$ causes the end $\mathbf{48}_I$ to be biased to the right of page causing a clockwise rotation of the detent member 45 about axis $D_2$. This movement causes the distal extent 150 of the detent member 45 to release from its supportive engagement with the contact portion 97.

Further upward movement of the body $\mathbf{35}_A$ results in the end 90 of the spacer member D transition from the vertically aligned planar surface $\mathbf{100}_B$ so as to run along the angled planar surface $\mathbf{100}_A$ whereby running contact is held due to the self-weight of the spacer member C causing clockwise rotation about the axis $P_2$ thereby biasing the end 90 toward the body $\mathbf{35}_A$. Completion of this movement results in the spacer member D converging toward its second position $\mathbf{20}_D$.

Any of the components of the drill rod spacer mover can be formed from any appropriate material from which mining related equipment is formed/made (those having high strength and/or high strength to weight characteristics), such as for example, appropriate grades of steels, aluminum. Materials having high corrosive resistance may also be useful.

Aspects of the principles described herein may involve various methods of operational use of the drill rod spacer mover arrangement (15) in storing drill rods and allowing access to them as part of a drilling operation.

Other aspects of the principles described herein may involve various methods for the installation or assembly of embodiments of one or more drill rod spacer movers ($\mathbf{15}_A$, $\mathbf{15}_B$) for operable use with a drill rod storage assembly (whether existing or otherwise) in the provision of a drill rod spacer mover arrangement falling within the principles described herein.

Modifications and variations may be made to the present invention within the context of that described herein and shown in the drawings. Such modifications are intended to form part of the inventive concept described in this specification.

It will be appreciated that future patent applications maybe filed in Australia or overseas on the basis of, or claiming priority from, the present application.

It is to be understood that the following claims are provided by way of example only and are not intended to limit the scope of what may be claimed in any such future application. Features may be added to or omitted from the provisional claims at a later date so as to further define or re-define the invention or inventions.

What is claimed is:

1. A drill rod storage assembly for storing a plurality of drill rods whereby adjacent drill rods are separated by a spacer member, the drill rod storage assembly comprising:

one or more drill rod spacer assemblies operable with a plurality of spacer members arranged in spaced relation, each drill rod spacer assembly comprising a body moveable along the spacing of the spacer members, each body configured for interacting with a respective spacer member while moving so as to move same to a respective first position for being supported thereat when the body moves to interact with another one of the spacer members.

2. A drill rod storage assembly according to claim 1, wherein the spacer members are each arranged in operable association with a respective detent member, each detent member being configured operable for supporting the respective spacer member in its first position when the respective body of the respective drill rod spacer moves to interact with another one of the spacer members.

3. A drill rod storage assembly according to claim 1, wherein each spacer member is moveable between the respective first position and a respective second position, said respective second position being one in which the respective spacer member provides support to one or more drill rods.

4. A drill rod storage assembly according to claim 1, wherein interaction between the respective body and the respective spacer member serves to move the respective spacer member to or toward its first position when the respective body is moving in a first direction of movement, and permits movement of the respective spacer member away from its first position when the respective body is moving in a second direction of movement, the second direction of movement being opposite to the first direction of movement.

5. A drill rod storage assembly according to claim 1, wherein each spacer member is arranged so as to rotate or pivot about a respective axis of rotation when moving toward or away from its respective first position, wherein the axis of rotation of each spacer member is not fixed, and has freedom to move or translate, wherein the scope of movement of the axis of rotation is constrained.

6. A drill rod storage assembly according to claim 5, wherein the scope of movement of the axis of rotation is constrained by travel being limited to movement within a slot.

7. A drill rod storage assembly according to claim 5, wherein rotation of each spacer member interacted with by the respective body toward or away from its first position depends on the direction of movement of the respective body.

8. A drill rod storage assembly according to claim 7, wherein each body comprises a second side configured for interacting with a portion of a respective detent member of the detent members for moving the respective detent member into a position in which the respective detent member provides support to an associated spacer member when in its respective first position.

9. A drill rod storage assembly according to claim 8, wherein each second side comprises a groove, each groove being configured so as to operate as a guide when interacting with said portion of the respective detent member for guiding movement of the respective detent member in moving the respective detent member into a position for conferring support to an associated spacer member when in its first position.

10. A drill rod storage assembly according to claim 8, wherein the shape of respective first and second sides of the respective body are configured so as to facilitate the following of respective paths of movement by the respective spacer member and the respective detent member operably associated therewith relative to the respective body, in the movement each spacer member to its respective first position and the movement of the detent member to a position for holding the respective spacer member in its first position; and the configuration of the second side of the respective body is arranged so as to cause an interaction between said second side and the respective detent member as the respective body passes thereby for causing a portion of said respective detent member to follow a path of movement operating to rotate said respective detent member toward or away from its respective spacer member support conferring position.

11. A drill rod storage assembly according to claim 1, wherein each spacer member comprises a projecting member which interacts with a channel or groove configured so as to limit the scope of rotational freedom of the spacer member about its axis of rotation.

12. A drill rod storage assembly according to claim 1, wherein each spacer member is rotatably supported by a support structure.

13. A drill rod storage assembly according to claim 12, wherein one or more of the spacer members are each arranged in operable association with a respective detent member, each detent member being configured operable for supporting the respective spacer member in its first position when the body moves to interact with another one of the spacer members, and the support structure is configured so as to rotatably support the detent members.

14. A drill rod storage assembly according to claim 1, wherein the bodies are operably associated with a rail along which each body is moveable in first and second directions by way of the drive transfer arrangement.

15. A drill rod storage assembly according to claim 1, wherein each body comprises a first side configured for interacting with a respective one of the spacer members as the respective body moves, said interaction causing rotation of the relevant spacer member to or toward its respective first position.

16. A drill rod storage assembly according to claim 15, wherein the first side of each body is configured having at least one surface portion which interacts with a portion of the respective spacer member in moving the respective spacer member to or toward its first position.

17. A drill rod storage assembly according to claim 16, wherein each surface portion is arranged so as to cause an interaction between said first side and the relevant spacer member as the body passes thereby which causes a portion of said relevant spacer member to follow a path of movement operating to rotate said relevant spacer member toward or away from its first position about its respective axis of rotation, depending on the direction of movement of the body.

18. A drill rod storage assembly according to claim 1, wherein one or more of the spacer members are each arranged in operable association with a respective detent member, each detent member being configured operable for supporting the respective spacer member in its first position, and each detent member comprises a body rotatable or pivotable about a respective axis of rotation; and the body of each detent member comprises a portion configured for engaging a portion of a respective spacer member associated therewith for supporting said spacer member in its first position.

19. A drill rod storage assembly according to claim 18, wherein the respective body includes a first side and a second side; each detent member comprising a projecting member which extends from its body so as to interact with a groove on the second side of the respective body; the projecting member of each detent member is dimensioned so as to be received within the groove of the second side of the respective body and, one or more edges defining the groove are configured so as to, when interacting with the projecting member of the detent member, bias the movement of the projecting member so as to cause the respective detent member to rotate about its axis of rotation.

20. A drill rod storage assembly according to claim 19, wherein, each detent member comprises a further projecting member which interacts with a channel or groove configured so as to limit the scope of rotational freedom of the detent member about its axis of rotation.

21. A drill rod storage assembly according to claim 19, wherein the first and second sides of the respective body are configured so that the interaction between the second side of the moving body and one of the detent members biases the detent member to or toward a position for supporting the respective spacer member at about the time the interaction between the first side of the moving body and the spacer member completes movement of the respective spacer member to its first position.

22. A drill rod spacer assembly comprising:

a plurality of spacer members each movable to a respective first position, a drive transfer unit configured operable for receiving drive for moving a body into contact with one of the spacer members, the contact and further movement of the body causing the one of the spacer members to pivot to its respective first position.

23. A drill rod spacer assembly comprising:

a plurality of spacer members each movable to a respective first position, a drive transfer unit configured operable for receiving drive for moving a body, the body having a portion configured so as to facilitate following of a path of movement by each of the spacer members when interacted with, in turn, by the body for moving each spacer member to its respective first position.

* * * * *